US011526127B2

(12) United States Patent
Matsumoto et al.

(10) Patent No.: US 11,526,127 B2
(45) Date of Patent: Dec. 13, 2022

(54) DEVELOPER CONTAINER WITH AIRFLOW SPACE

(71) Applicant: CANON KABUSHIKI KAISHA, Tokyo (JP)

(72) Inventors: Atsushi Matsumoto, Ibaraki (JP); Hirotoshi Tajima, Ibaraki (JP); Kosuke Takeuchi, Chiba (JP); Takashi Ninomiya, Chiba (JP); Ryosuke Kosone, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/231,971

(22) Filed: Apr. 15, 2021

(65) Prior Publication Data

US 2021/0333753 A1 Oct. 28, 2021

(30) Foreign Application Priority Data

Apr. 22, 2020 (JP) ..... JP2020-075814
Mar. 16, 2021 (JP) ..... JP2021-042240

(51) Int. Cl.
*G03G 21/20* (2006.01)
*G03G 15/09* (2006.01)

(52) U.S. Cl.
CPC ..... *G03G 21/206* (2013.01); *G03G 15/0935* (2013.01); *G03G 2221/1645* (2013.01)

(58) Field of Classification Search
CPC ..... G03G 21/206; G03G 15/0886; G03G 21/1676; G03G 2215/0692; G03G 15/0898; G03G 21/0052; G03G 15/0935
See application file for complete search history.

(56) References Cited

U.S. PATENT DOCUMENTS

2010/0080606 A1* 4/2010 Ohashi ..... G03G 21/206 399/92
2012/0237249 A1* 9/2012 Utsunomiya ..... G03G 15/0898 399/92

(Continued)

FOREIGN PATENT DOCUMENTS

JP 2004361869 A 12/2004
JP 2008170738 A 7/2008

(Continued)

*Primary Examiner* — Jessica L Eley
(74) *Attorney, Agent, or Firm* — Canon U.S.A., Inc. I.P. Division

(57) ABSTRACT

An image forming apparatus includes an image bearing member, a developing apparatus, a driving device, an airflow space portion, a duct, and, a drawing fan. A driving-force transmission member, the driving device and the airflow space portion are disposed on a side on which a developer container faces the image bearing member. The driving-force transmission member, the driving device, the duct and the drawing fan are disposed on one end side of a developing rotary member in a rotation-axis direction of the developing rotary member. The duct is disposed underneath the developer container, formed from the side on which the developer container faces the image bearing member to a side opposite to the side on which the developer container faces the image bearing member. The drawing fan is disposed on the side opposite to the side on which the developer container faces the image bearing member.

14 Claims, 19 Drawing Sheets

(56) References Cited

U.S. PATENT DOCUMENTS

| | | | | |
|---|---|---|---|---|
| 2013/0108310 | A1* | 5/2013 | Hirakawa | G03G 15/0898 399/92 |
| 2014/0294429 | A1* | 10/2014 | Inui | G03G 21/105 399/99 |
| 2017/0017200 | A1* | 1/2017 | Oya | G03G 21/206 |

FOREIGN PATENT DOCUMENTS

| | | | |
|---|---|---|---|
| JP | 2009047887 | A | 3/2009 |
| JP | 2011191522 | A | 9/2011 |
| JP | 2013015662 | A | 1/2013 |
| JP | 2018180267 | A | 11/2018 |

* cited by examiner

FIG.18

| | | HUMIDITY (%) | | | | |
|---|---|---|---|---|---|---|
| | | 80 OR MORE | 79 to 61 | 60 to 41 | 40 to 21 | 20 OR LESS |
| TEMPERATURE (°C) | 40 OR MORE | A100%<br>B100% | A100%<br>B100% | A100%<br>B100% | A100%<br>B100% | A100%<br>B100% |
| | 35 to 39 | A80%<br>B100% | A80%<br>B90% | A80%<br>B80% | A80%<br>B80% | A80%<br>B80% |
| | 30 to 34 | A60%<br>B100% | A60%<br>B90% | A60%<br>B80% | A60%<br>B70% | A60%<br>B60% |
| | 25 to 29 | A40%<br>B100% | A40%<br>B90% | A40%<br>B80% | A40%<br>B70% | A40%<br>B60% |
| | 20 to 24 | A20%<br>B100% | A20%<br>B90% | A20%<br>B80% | A20%<br>B70% | A20%<br>B60% |

DEVELOPER CONTAINER WITH AIRFLOW SPACE

BACKGROUND

Field of the Disclosure

The present disclosure generally relates to an image forming apparatus including a developing apparatus that develops an electrostatic latent image formed on an image bearing member, by using developer that contains toner and carrier.

Description of the Related Art

Image forming apparatuses include a developing apparatus that develops an electrostatic latent image formed on a photosensitive drum (image bearing member), by using developer that contains toner and carrier. In such a developing apparatus, a developing sleeve (developing rotary member) bears the developer of a developer container, and conveys the developer to an area that faces the photosensitive drum, for forming an image. In this operation, the toner (hereinafter referred to as scattering toner) may scatter from the developing sleeve into a space between the developer container and the photosensitive drum, and leak from the developer container to the outside making the interior of the image forming apparatus dirty.

An image forming apparatus disclosed in Japanese Patent Application Publication No. 2011-191522 includes a developing apparatus having a toner receiving portion to receive the scattering toner. In the image forming apparatus, a flow path is formed below the developing sleeve and between the developer container, the photosensitive drum, and the toner receiving portion. The flow path extends in the rotation-axis direction of the photosensitive drum (i.e., rotation-axis direction of the developing sleeve), and air can flow in the flow path. In addition, in the image forming apparatus, an opening portion is formed in the developer container, and the air is drawn through the opening portion by a fan. Thus, when the air is drawn through the opening portion by the fan, airflow is generated in the flow path in the rotation-axis direction of the photosensitive drum. In this manner, in the configuration disclosed in Japanese Patent Application Publication No. 2011-191522, the scattering toner is carried by the airflow in the flow path and collected from an opening portion of the developer container.

In the developing apparatus, a driving-force transmission member and a driving device are disposed on one end side of the developing apparatus in the longitudinal direction of the developing apparatus (i.e., rotation-axis direction of the developing sleeve). The driving-force transmission member includes a gear and a coupling, and transmits driving force to rotate the developing sleeve to the developing sleeve. The driving device is a motor for example, and provides the driving force to the driving-force transmission member.

As described above, in the configuration disclosed in Japanese Patent Application Publication No. 2011-191522, the scattering toner is carried by the airflow in the flow path and collected from the opening portion of the developer container. In this configuration, if the flow path is formed on a side on which the driving-force transmission member and the driving device are disposed, a space in which the fan that draws the air through the opening portion is disposed may have to be secured in the developing apparatus such that the fan does not interfere with the driving-force transmission member and the driving device.

SUMMARY

The present disclosure provides an image forming apparatus whose size is not increased even if the fan, which draws the air through the opening portion, is disposed in the configuration in which the scattering toner is carried by the airflow in the airflow space portion and collected from the opening portion of the developer container.

According to one aspect of the present disclosure, an image forming apparatus includes an image bearing member, an exposure apparatus, a developing apparatus, a driving device, an airflow space portion, a duct, and, a drawing fan. The exposure apparatus is configured to expose the image bearing member for forming an electrostatic latent image on the image bearing member. The developing apparatus includes a developer container configured to accommodate developer that contains toner and carrier, a developing rotary member configured to bear the developer and convey the developer to a developing position at which the electrostatic latent image formed on the image bearing member is developed, and, a driving-force transmission member disposed on a side on which the developer container faces the image bearing member and on one end side of the developing rotary member in a rotation-axis direction of the developing rotary member, and configured to transmit driving force to the developing rotary member to rotate the developing rotary member. The driving device is disposed on the side on which the developer container faces the image bearing member and on the one end side of the developing rotary member in the rotation-axis direction of the developing rotary member, and configured to provide the driving force to the driving-force transmission member. The airflow space portion is disposed on the side on which the developer container faces the image bearing member, formed from the one end side to another end side of the developing rotary member in the rotation-axis direction of the developing rotary member, and configured to serve as a flow path of air that collects toner that scatters from the developing rotary member. The duct is disposed on the one end side of the developing rotary member in the rotation-axis direction of the developing rotary member and underneath the developer container, formed from the side on which the developer container faces the image bearing member to a side opposite to the side on which the developer container faces the image bearing member, and connected to the airflow space portion such that air flows between the airflow space portion and the duct. The drawing fan is disposed on the side opposite to the side on which the developer container faces the image bearing member and on the one end side of the developing rotary member in the rotation-axis direction of the developing rotary member, and configured to draw air from an opening portion of the duct for generating airflow in the airflow space portion.

Further features of the present disclosure will become apparent from the following description of exemplary embodiments with reference to the attached drawings.

BRIEF DESCRIPTION OF THE DRAWINGS

FIG. 18 illustrates an environment table used for fan control of the third embodiment.

DESCRIPTION OF THE EMBODIMENTS

First Embodiment

Figure 1:
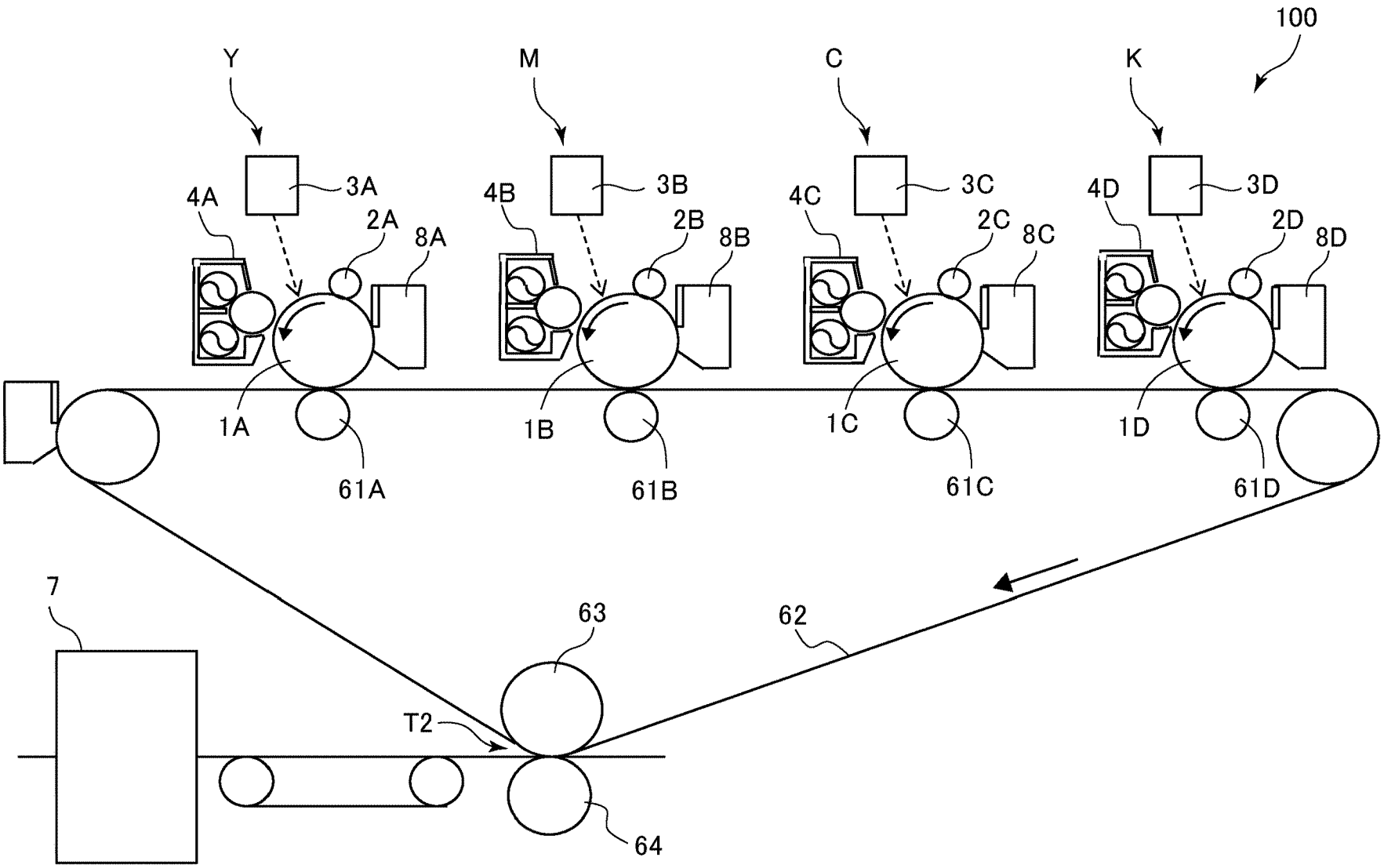
FIG. 1 is a cross-sectional view of a schematic configuration of an image forming apparatus of a first embodiment.

A first embodiment will be described with reference to FIGS. 1 to 12. First, with reference to FIG. 1, a schematic configuration of an image forming apparatus of the present embodiment will be described.

Image Forming Apparatus

An image forming apparatus 100 is a tandem-type image forming apparatus in which image forming portions Y, M, C, and K are disposed along a rotational direction of an intermediate transfer belt 62. The image forming portions Y, M, C, and K respectively form toner images of four colors of yellow, magenta, cyan, and black. The image forming apparatus 100 forms a toner image on a recording material, in accordance with an image signal sent from a document reading apparatus (not illustrate) connected to an apparatus body, or from a host device, such as a personal computer, communicatively connected to the apparatus body. The recording material may be a sheet material, such as a paper sheet, a plastic film, or a cloth sheet.

The four image forming portions Y, M, C, and K of the image forming apparatus 100 have substantially the same configuration, except that their developing colors are different from each other. Thus, in the following description, the image forming portion Y will be described as an example, and the description for the other image forming portions will be omitted.

In the image forming portion Y, a cylindrical photosensitive member that serves as an image bearing member, that is, a photosensitive drum 1A is disposed. The photosensitive drum 1A is rotated in a direction indicated by an arrow of FIG. 1. Around the photosensitive drum 1A, a charging roller 2A, a developing apparatus 4A, a primary transfer roller 61A, and a cleaning apparatus 8A are disposed. Above the photosensitive drum 1A in FIG. 1, a laser scanner (exposure apparatus) 3A is disposed.

An intermediate transfer belt 62 serves as an intermediate transfer member, and is disposed so as to face the photosensitive drums 1A, 1B, 1C, and 1D. The intermediate transfer belt 62 is stretched by and wound around a plurality of stretching rollers, and revolved (rotated) in a direction indicated by an arrow of FIG. 1, by a driving roller of the plurality of stretching rollers. A secondary transfer outer roller 64 is disposed at a position at which the secondary transfer outer roller 64 faces, via the intermediate transfer belt 62, a secondary transfer inner roller 63 of the plurality of stretching rollers, and forms a secondary transfer portion T2 in which a toner image formed on the intermediate transfer belt 62 is transferred onto a recording material. A fixing apparatus 7 is disposed downstream of the secondary transfer portion T2 in a recording-material conveyance direction.

In the image forming apparatus 100 configured in this manner, an image is formed as described below. First, the surface of the photosensitive drum 1A is uniformly charged by the charging roller 2A. The charged surface is exposed by the laser scanner 3A, and an electrostatic latent image is formed on the photosensitive drum 1A. The electrostatic latent image obtained in this manner is developed into a toner image by the developing apparatus 4A causing the toner to stick to the electrostatic latent image. The toner image is transferred onto the intermediate transfer belt 62 by the primary transfer roller 61A. Such an operation is performed also in the image forming portions M, C, and K in a sequential manner, and four-color toner images are superposed on each other on the intermediate transfer belt 62.

After the four-color toner images are transferred onto the intermediate transfer belt 62 so as to be superposed on each other, the four-color toner image is transferred onto a recording material having been conveyed from a feeding cassette (not illustrated) to the secondary transfer portion T2. The recording material is then heated and pressed by the fixing apparatus 7 for fixing the toner image to the recording material, and discharged to the outside of the image forming apparatus 100. The toner left on the photosensitive drum 1A after the toner image is transferred onto the intermediate transfer belt 62 is removed by the cleaning apparatus 8A.

Developing Apparatus

Next, the developing apparatus 4A of the present embodiment will be described with reference to FIGS. 2 and 3. Note that since the other developing apparatuses 4B, 4C, and 4D have the same configuration as that of the developing apparatus 4A, the description and illustration thereof will be omitted.

The developing apparatus 4A includes a developer container 41, a cylindrical developing sleeve (developing rotary member) 44*a* that serves as a developer bearing member, and a regulation member 42. The developer container 41 accommodates developer that contains nonmagnetic toner and magnetic carrier. The developer container 41 has an opening portion that faces the photosensitive drum 1A (FIG. 1), and the developing sleeve 44*a* is rotatably disposed in the opening portion such that one portion of the developing sleeve 44*a* is exposed from the opening portion.

The developing sleeve 44*a* is disposed so as to face the photosensitive drum 1A. When rotated, the developing sleeve 44*a* bears the developer of the developer container 41 and conveys the developer to an area (developing area) in which the developing sleeve 44*a* faces the photosensitive drum 1A, for developing an electrostatic latent image formed on the photosensitive drum (image bearing member) 1A. The developing sleeve 44*a* is disposed such that the rotation-axis direction of the developing sleeve 44*a* is substantially equal to the rotation-axis direction of the photosensitive drum 1A.

In addition, a driving-force transmission member 221 and a driving device 220 are disposed on one end side of the developing apparatus 4A in the longitudinal direction of the developing apparatus (i.e., rotation-axis direction of the developing sleeve 44*a*). The driving-force transmission member 221 includes a gear and a coupling, and transmits driving force to rotate the developing sleeve 44*a*. The driving device 220 is a motor for example, and provides the driving force to the driving-force transmission member 221. Note that the driving-force transmission member 221 and the driving device 220 are disposed adjacent to each other along the longitudinal direction of the developing apparatus 4A.

Figure 3:
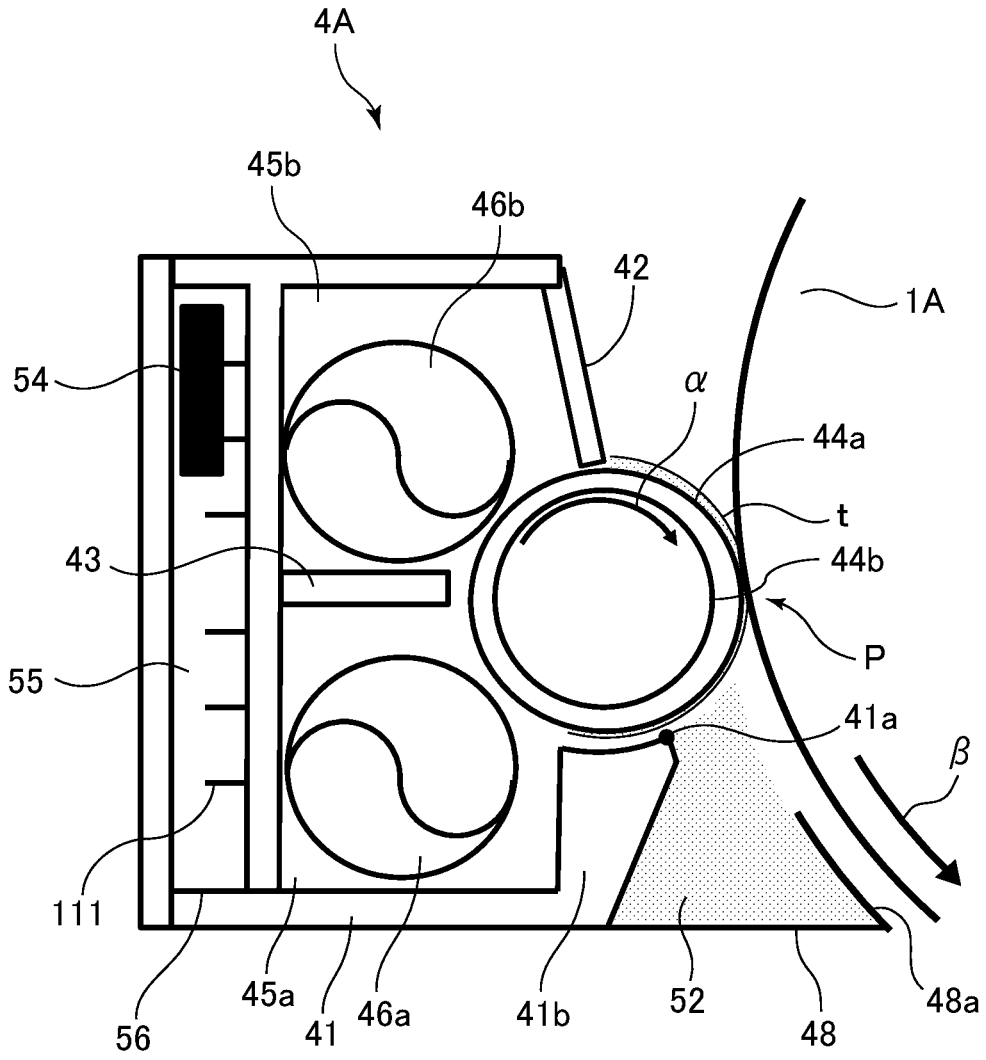
FIG. 3 is a cross-sectional view taken along a broken line A of FIG. 2.
Figure 8:
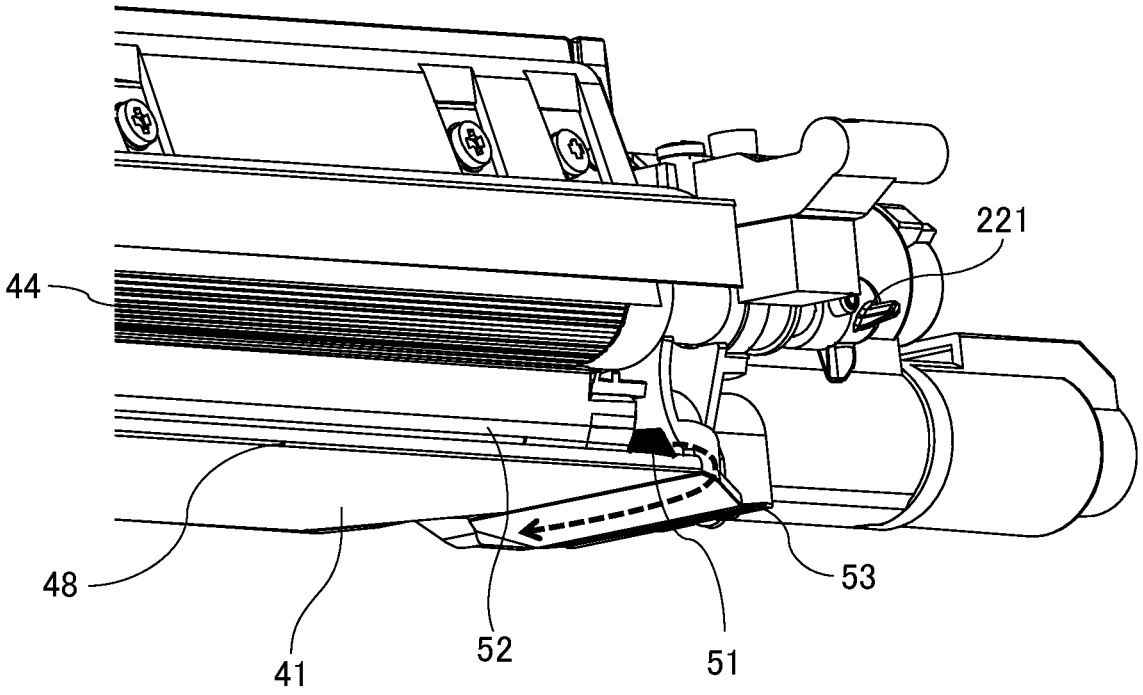
FIG. 8 is a perspective view of one portion of the developing apparatus of the first embodiment, viewed from a developing sleeve side.

When the driving force of the motor (driving device 220) is transmitted to the coupling (driving-force transmission member 221) illustrated in FIG. 8 and disposed on one end portion of the developing sleeve 44*a* in the rotation-axis direction, the developing sleeve 44*a* is rotated in a direction indicated by an arrow a of FIG. 3. The rotational direction (forward direction) of the developing sleeve 44*a* is the same as the rotational direction (indicated by an arrow β of FIG. 3) of the photosensitive drum 1A at a position at which the developing sleeve 44*a* faces the photosensitive drum 1A.

The developing sleeve 44*a* has a magnet roll 44*b* formed inside the developing sleeve 44*a* and serving as a magnetic-field generating portion. The magnet roll 44*b* is formed so as not to rotate. The magnet roll 44*b* has a plurality of magnetic poles formed along the rotational direction of the developing sleeve 44*a*, and causes the developer to magnetically stick to the surface of the nonmagnetic developing sleeve 44*a*. The regulation member 42 is disposed such that a predetermined clearance is formed between the regulation member 42 and the developing sleeve 44*a*, and regulates the height of magnetic brush of the developer (e.g., thickness of the developer) formed on the developing sleeve 44*a*. The magnetic brush is the carrier to which the toner has adhered and which has been formed sequentially on the developing sleeve 44*a* like a brush.

The developer container 41 is partitioned into a first developer-conveyance path (first chamber) 45*a* and a second developer-conveyance path (second chamber) 45*b* by a partition wall 43 that extends in a horizontal direction. In the first developer-conveyance path 45*a*, a first screw 46*a* is disposed as a first conveyance member. In the second developer-conveyance path 45*b*, a second screw 46*b* is disposed as a second conveyance member.

The first screw 46*a* conveys the toner, which is supplied from a toner supply device (not illustrated) to the developer container 41, and the developer of the first developer-conveyance path 45*a* while agitating them, and makes the toner density uniform. The second screw 46*b* conveys the developer of the second developer-conveyance path 45*b* while agitating the developer. In addition, at both end portions of the partition wall 43 in the width direction of the partition wall 43 (e.g., rotation-axis direction of the developing sleeve 44*a*), communicating openings (a first communicating portion and a second communicating portion) are formed for causing the first developer-conveyance path 45*a* and the second developer-conveyance path 45*b* to communicate with each other. The first communicating portion causes the first developer-conveyance path 45*a* and the second developer-conveyance path 45*b* to communicate with each other such that the developer moves from the first developer-conveyance path 45*a* to the second developer-conveyance path 45*b*. The second communicating portion causes the first developer-conveyance path 45*a* and the second developer-conveyance path 45*b* to communicate with each other such that the developer moves from the second developer-conveyance path 45*b* to the first developer-conveyance path 45*a*. The second screw 46*b* conveys the developer in a first direction in which the developer moves from the first communicating portion toward the second communicating portion. The first screw 46*a* conveys the developer in a second direction in which the developer moves from the second communicating portion toward the first communicating portion. Thus, the first developer-conveyance path 45*a* and the second developer-conveyance path 45*b* form a circulation path in which the developer circulates.

In the present embodiment, the developer accommodated in the developer container 41 is two-component developer into which the negatively charged nonmagnetic toner and the magnetic carrier are mixed with each other. The nonmagnetic toner is powder made through pulverization or polymerization and made of resin, such as polyester or styrene. The powder contains coloring agent and a wax component. In the present embodiment, the powder used has an average particle diameter of 5 μm. The magnetic carrier is particles, each having a resin core in which ferrite particles or magnetic powder are mixed. The core is coated with resin.

Next, a developing process in which the toner is supplied to the photosensitive drum 1A in the developing area will be described. As illustrated in FIG. 1, the photosensitive drum 1A is charged uniformly by the charging roller 2A at a charge potential Vd, and an image portion of the photosensitive drum 1A, on which an image is to be formed, is exposed by the laser scanner 3A so as to have an exposure potential of V1 [V]. The developing sleeve 44*a* is applied with a direct-current voltage, or with an alternate-current voltage added to a direct-current voltage. When the developing sleeve 44*a* is applied with a direct-current voltage Vdc, a voltage Vcont that is an absolute value |Vdc−V1| of a difference between the direct-current voltage Vdc and the exposure potential V1 produces the electric field that conveys the toner to the image portion.

In contrast, a voltage Vback that is an absolute value |Vdc−Vd| of a difference between the direct-current voltage Vdc and the charge potential Vd produces an electric field that pulls the toner from the photosensitive drum 1A back to the developing sleeve 44*a*. The electric field is produced to suppress a fog phenomenon that causes the toner to stick to a non-image portion.

The developing sleeve 44*a* rotates toward a direction indicated by an arrow a of FIG. 3, and conveys the developer toward the regulation member 42 while the magnetic field of the magnet roll 44*b* disposed in the developing sleeve 44*a* causes the developer to stick to the developing sleeve 44*a*. The developer is formed like a brush, and the thickness of the developer is regulated by the regulation member 42. When the developer passes through the clearance between the developing sleeve 44*a* and the regulation member 42, a developer layer having a predetermined thickness is formed on the developing sleeve 44*a*. The developer layer, borne by the developing sleeve 44*a*, is conveyed to the developing area that faces the photosensitive drum 1A, by the rotation of the developing sleeve 44*a*. In the developing area, the developer formed like a magnetic brush develops an electrostatic latent image formed on the surface of the photosensitive drum 1A. Specifically, the developer contacts the photosensitive drum 1A, and develops the electrostatic latent image when the developer contacts the photosensitive drum 1A. Thus, the clearance between the photosensitive drum 1A and the developing sleeve 44*a* is filled with the developer. The developer having been used for the developing is conveyed to a separation area by the rotation of the developing sleeve 44*a*, and separated from the developing sleeve 44*a* in the separation area and returned to the developer container 41.

The developing apparatus 4A of the present embodiment is a function-separated developing apparatus in which the developer is supplied from the second developer-conveyance path (supply chamber) 45*b* to the developing sleeve 44*a* and collected from the developing sleeve 44*a* in the first developer-conveyance path (collection chamber) 45*a*. In addition, the developing apparatus 4A is a vertically-agitating developing apparatus in which the second developer-conveyance path 45*b* is disposed above the first developer-conveyance path 45*a*. In this configuration, the developing sleeve 44*a* rotates downward in the gravity direction at a position at which the developing sleeve 44*a* faces the photosensitive drum 1A.

In the first developer-conveyance path 45*a* of the function-separated developing apparatus, the developer is conveyed downstream in the developer conveyance direction, and the developer is collected from the developing sleeve 44*a* in a portion of the first developer-conveyance path 45*a* extending from the upstream side to the downstream side in the developer conveyance direction. Thus, in the first developer-conveyance path 45*a*, the amount of developer tends to be more in a downstream portion than in an upstream portion in the developer conveyance direction. In contrast, in the second developer-conveyance path 45*b* of the function-separated developing apparatus, the developer is conveyed downstream in the developer conveyance direction, and the developer is supplied to the developing sleeve 44*a* in a portion of the second developer-conveyance path 45*b* extending from the upstream side to the downstream side in the developer conveyance direction. Thus, in the second developer-conveyance path 45*b*, the amount of developer tends to be less in a downstream portion than in an upstream portion in the developer conveyance direction.

As a result, in the second developer-conveyance path 45*b* of the function-separated developing apparatus, the height of the developer surface becomes lower in the downstream portion than in the upstream portion in the developer conveyance direction. If the height of the developer surface decreases in the second developer-conveyance path 45*b*, the amount of developer that is thrown up by the second screw 46*b* increases, increasing the density of developer contained in the air.

In addition, when the developing sleeve 44*a* is rotated, air is taken in through a clearance between the developing sleeve 44*a* and the developer container 41. In the upstream portion of the second developer-conveyance path 45*b* in the developer conveyance direction, since the height of the developer surface is high and the upstream portion is filled with the developer, the flow path for the air is small, and the amount of air that flows into the developer container 41 tends to decrease. In contrast, in the downstream portion of the second developer-conveyance path 45*b* in the developer conveyance direction, since the height of the developer surface is low and the amount of developer is less, the flow path for the air is large, and the amount of air that flows into the developer container 41 tends to increase.

The air taken into the developer container 41 by driving the developing sleeve 44*a* increases the internal pressure of the developer container 41. As a result, the toner easily scatters through a clearance between the developing sleeve 44*a* and the developer container 41 for keeping the internal pressure. In this manner, more air flows into and out of the developer container 41 in the downstream portion of the second developer-conveyance path 45*b*, which is located in the developer conveyance direction and has a lower developer surface, than in the upstream portion of the second developer-conveyance path 45*b*, which is located in the developer conveyance direction and has a higher developer surface.

Consequently, in the second developer-conveyance path 45*b* of the function-separated developing apparatus, the density of developer in the air is made larger by the second screw 46*b* throwing up the developer, in the downstream portion of the second developer-conveyance path 45*b*, which is located in the developer conveyance direction and has a lower developer surface. In addition, in the downstream portion of the second developer-conveyance path 45*b*, since the amount of airflow caused by driving the developing sleeve 44*a* increases, the amount of scattering toner tends to increase.

Shape of Developer Container

Next, a shape of the developer container 41 will be further described with reference to FIGS. 2 and 3. The developer container 41 includes a projection portion (toner receiving portion) 48 that projects from a lower edge portion of the developer container 41 toward the photosensitive drum 1A. In addition, the developer container 41 includes end-portion ribs 49*a* and 49*b* formed at both end portions of the developer container 41 in the longitudinal direction of the developer container 41 that crosses the rotational direction (indicated by the arrow a) of the developing sleeve 44*a*. The end-portion ribs 49*a* and 49*b* are formed so as to project toward the photosensitive drum 1A.

The projection portion 48 is disposed downstream of a closest position (developing position) P in the rotational direction of the developing sleeve 44*a*. The closest position P is a position at which the developing sleeve 44*a* and the photosensitive drum 1A are located closest to each other. In the present embodiment, the projection portion 48 is disposed below the closest position P in the gravity direction. In the example illustrated in FIGS. 2 and 3, the projection portion 48 is disposed at a lower edge portion of the developer container 41. The developer container 41 includes a wall portion 41*b* that forms the first developer-conveyance path 45*a*. The wall portion 41*b* is formed in the first developer-conveyance path 45*a* on the photosensitive drum 1A side, and an upper edge portion of the wall portion 41*b* faces the developing sleeve 44*a*. The projection portion 48 is formed so as to project from a lower edge portion of the wall portion 41*b* toward the photosensitive drum 1A.

The projection portion 48 extends in the longitudinal direction of the developer container 41 (i.e., rotation-axis direction of the developing sleeve 44*a*) that crosses the rotational direction of the developing sleeve 44*a*, and is formed such that a clearance is formed between the projection portion 48 and the photosensitive drum 1A. In the present embodiment, the projection portion 48 extends from the end-portion rib 49*a* to the end-portion rib 49*b*. For example, the clearance between the projection portion 48 and the photosensitive drum 1A is 2 mm.

In addition, the projection portion 48 has a bent portion 48*a* formed at a leading edge of the projection portion 48 and bent upward so that the projection portion 48 can hold the toner that falls from the developing sleeve 44*a*. The bent portion 48*a* is curved or sloped in accordance with the curvature of the surface of the photosensitive drum 1A. For example, the clearance between the leading edge of the projection portion 48 that includes the bent portion 48*a* and the photosensitive drum 1A is 2 mm. Note that the bent portion 48*a* may not be formed.

The end-portion rib 49*a* serves as a first end-portion projection portion, and is formed at an end portion of the developer container 41 in the longitudinal direction of the developer container 41. In the present embodiment, one end portion of the developer container 41 located on the front side of the image forming apparatus, that is, on the side of the image forming apparatus on which the image forming apparatus is operated, is referred to as the other end portion in the longitudinal direction. The end-portion rib 49*b* serves as a second end-portion projection portion; and is formed at an end portion, opposite to the end portion, of the developer container 41 in the longitudinal direction of the developer container 41. The end portion of the developer container 41 opposite to the other end portion in the longitudinal direction is an end portion located on the back side of the image forming apparatus, and is referred to as one end portion in the longitudinal direction.

The end-portion ribs 49*a* and 49*b* are formed at least from the closest position P to the projection portion 48 such that a clearance is formed between the end-portion ribs 49*a* and 49*b* and the photosensitive drum 1A. In the present embodiment, the end-portion ribs 49*a* and 49*b* are formed from a position above the closest position P in the gravity direction, to a lower edge portion of the developer container 41; and face the photosensitive drum 1A via the clearance. Preferably, the end-portion ribs 49*a* and 49*b* are disposed such that, when viewed from the longitudinal direction of the developer container 41 that crosses the rotational direction of the developing sleeve 44*a*, the end-portion ribs 49*a* and 49*b* cover an area in which the developer borne by the developing sleeve 44*a* contacts the photosensitive drum 1A and an area located under the area in the gravity direction. For example, the clearance between the end-portion ribs 49*a* and 49*b* and the photosensitive drum 1A is 2 mm.

Airflow Space Portion

In the present embodiment, since the developer container 41 has the projection portion 48 and the end-portion ribs 49*a* and 49*b* as described above, an airflow space portion 52 is formed in the developer container 41, as a first airflow space portion. Specifically, the airflow space portion 52 is surrounded by the photosensitive drum 1A, the developing sleeve 44*a*, the projection portion 48, and the end-portion ribs 49*a* and 49*b*; and the air can flow in the airflow space portion 52. The airflow space portion 52 is formed on a side on which the developer container 41 faces the photosensitive drum 1A, and extends from one end side to the other end side of the developing sleeve 44*a* in the rotation-axis direction of the developing sleeve 44*a*. In addition, the airflow space portion 52 is a flow path of air for collecting the toner that scatters from the developing sleeve 44*a*. In FIG. 3, the airflow space portion 52 is a stipple pattern portion that does not include a portion representing a developer t.

Figure 2:
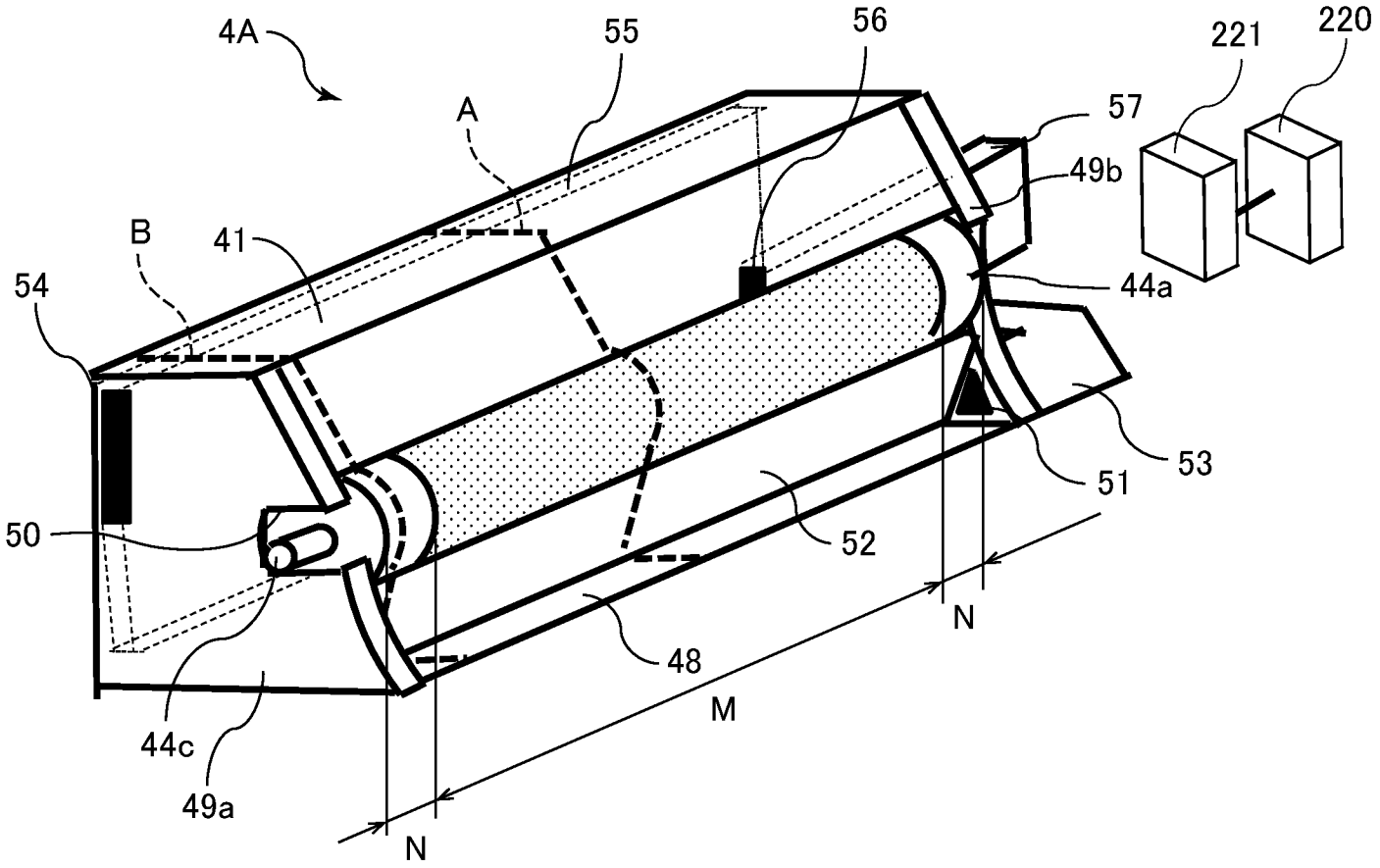
FIG. 2 is a perspective view of a schematic configuration of a developing apparatus of the first embodiment.

FIG. 3 illustrates a cross section taken along a broken line A of FIG. 2, which indicates a center portion of the developing apparatus 4A in the longitudinal direction of the developing apparatus 4A. As illustrated by the stipple pattern portion, the developer t is borne by the developing sleeve 44*a*, and the clearance between the developing sleeve 44*a* and the photosensitive drum 1A is blocked with the developer t.

As the developing apparatus operates faster, the developer more easily scatters from the developing sleeve 44*a*. In the present embodiment, the developer that scatters from the developing sleeve 44*a* is drawn through the airflow space portion 52 for suppressing the developer from flying to the outside of the developing apparatus 4A. Thus, as illustrated in FIG. 2, an inflow opening portion 50 is formed in the front-side end-portion rib 49*a* as an air inflow portion, and a drawing opening portion 51 is formed in the back-side end-portion rib 49*b* as an air drawing portion. In this manner, the air flows in the airflow space portion 52 through the two opening portions.

Hereinafter, the detailed description thereof will be made. The inflow opening portion 50 serves as a first opening portion, and passes through the end-portion rib 49*a* in the longitudinal direction. The air can flow from the outside of the developer container 41 into the airflow space portion 52 through the inflow opening portion 50. The drawing opening portion 51 serves as a second opening portion, and passes through the end-portion rib 49*b* in the longitudinal direction. The air can be drawn from the airflow space portion 52 through the drawing opening portion 51.

The inflow opening portion 50 is formed at a position located upstream of an upstream edge 41*a* (FIG. 3) of a portion of the developer container 41 in the rotational direction of the developing sleeve 44*a*. The portion of the developer container 41 faces the developing sleeve 44*a* at a position located downstream of the closest position P in the rotational direction of the developing sleeve 44*a*. In addition, the inflow opening portion 50 is formed so as to be opened up to a position located upstream of an area (developing nip portion) in the rotational direction of the developing sleeve 44*a*. The developing nip portion is an area in which the developer borne by the developing sleeve 44*a* contacts the photosensitive drum 1A.

In the present embodiment, the inflow opening portion 50 is formed in an area that includes the closest position P in the rotational direction of the developing sleeve 44*a*. In other words, the inflow opening portion 50 is formed upstream of the upstream edge 41*a*, and includes an area located upstream of the developing nip portion in which the developer borne by the developing sleeve 44*a* contacts the photosensitive drum 1A.

Specifically, the above-described upstream edge 41*a* is an upstream edge of the wall portion 41*b* of the developer container 41 in the gravity direction, and the upstream edge 41*a* of the wall portion 41*b* faces the developing sleeve 44*a*. In addition, the inflow opening portion 50 is formed above a horizontal line L (see FIG. 5) that passes through the upstream edge 41*a*. That is, the lower edge of the inflow opening portion 50 in the gravity direction is located above the horizontal line L, which passes through the upstream edge 41*a*. On the other hand, the upper edge of the inflow opening portion 50 in the gravity direction is preferably below the upper edge of the developing sleeve 44*a* in the gravity direction.

The inflow opening portion 50 is formed so as to be opened toward the photosensitive drum 1A. With this shape, when the developing sleeve 44*a* is assembled to the developer container 41, a rotation shaft 44*c* of the developing sleeve 44*a* can move in the inflow opening portion 50. The rotation shaft 44*c* having moved in the inflow opening portion 50 is rotatably supported by a rotation support portion (not illustrated).

Preferably, an edge portion of the inflow opening portion 50 opposite to the photosensitive drum 1A is not located in the first developer-conveyance path 45*a* and the second developer-conveyance path 45*b*. In other words, when viewed from the longitudinal direction, the inflow opening portion 50 is preferably formed so as to overlap with the developing sleeve 44*a*. This is because if the inflow opening portion 50 is opened also to the first developer-conveyance path 45*a* or the second developer-conveyance path 45*b*, the developer will easily leak from the first developer-conveyance path 45*a* or the second developer-conveyance path 45*b* to the outside through the inflow opening portion 50.

The drawing opening portion 51 is formed downstream of the developing nip portion in the rotational direction of the developing sleeve 44*a*. In the present embodiment, when viewed from the longitudinal direction, the drawing opening portion 51 is formed so as to be included by the airflow space portion 52 and be opened to the airflow space portion 52. The shape of the drawing opening portion 51 is substantially the same as the shape of the airflow space portion 52 in a cross section orthogonal to the longitudinal direction of the airflow space portion 52. In the present embodiment, the drawing portion 51 is nearly rectangular.

Figure 7:
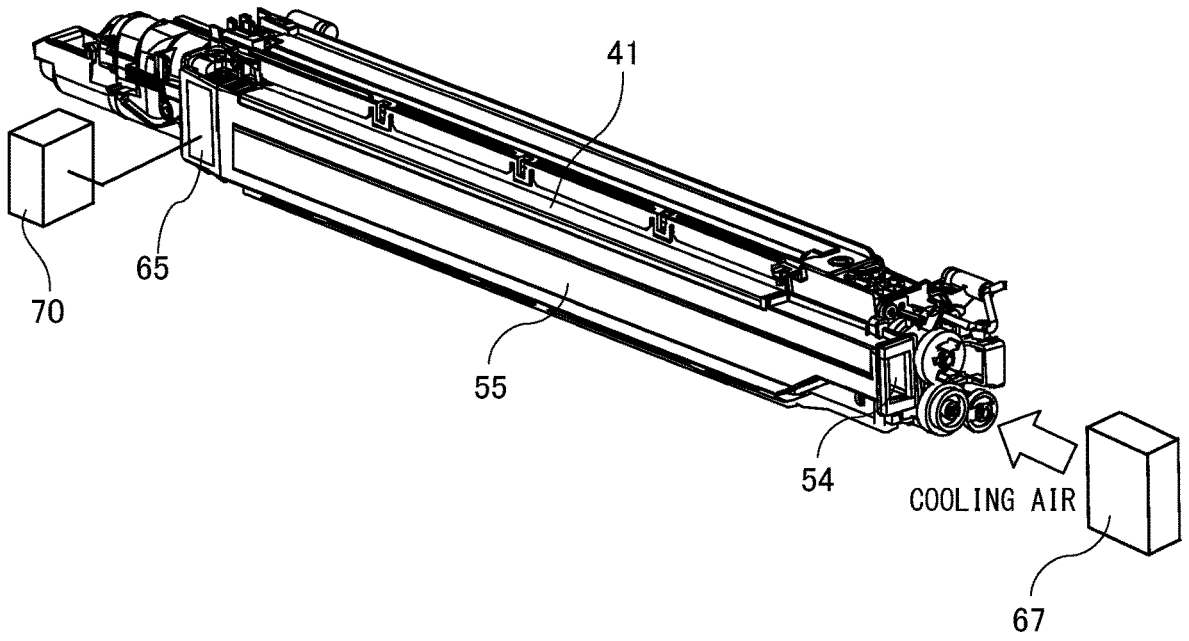
FIG. 7 is a perspective view of the developing apparatus of the first embodiment, viewed from a cooling duct side.

As illustrated in FIG. 7 described later, the drawing opening portion 51 is connected to a drawing fan 70 via a duct 53 and the like. The drawing fan 70 serves as an airflow generating portion that generates airflow, and is disposed in an apparatus body of the image forming apparatus. Thus, when the developing apparatus 4A is attached to the apparatus body, the drawing fan 70 is connected with the duct 53. The detailed configuration thereof will be described later. The drawing opening portion 51 draws air of the airflow space portion 52 by the drawing fan 70 generating the airflow.

As illustrated in FIG. 2, the developing sleeve 44*a* includes a first area (image forming area) M and second areas N, which are formed in the longitudinal direction (rotation-axis direction). The first area M is an area whose surface bears the developer. The second areas N are areas whose surfaces do not bear the developer. The first area M is formed in a center portion of the developing sleeve 44*a* in the longitudinal direction, and is an area that allows a maximum-size image to be formed on the photosensitive drum 1A. That is, the first area M is a maximum-size image area that is largest in the longitudinal direction (rotation-axis direction) of the photosensitive drum 1A, and that allows a maximum-size electrostatic latent image to be formed. Thus, the first area M is an area on which the developing sleeve 44*a* bears the developer for developing the electrostatic latent image.

For example, the first area M of the developing sleeve 44*a* has concave and convex portions or grooves formed in the surface of the first area M, for easily bearing the developer. Specifically, in the first area M, blasting is performed on the surface of the first area M, a plurality of grooves that extends in the longitudinal direction is formed along the circumferential direction, or a plurality of concave portions called dug holes is formed in the surface of the first area M.

The second areas N are formed at both edge portions of the first area M in the longitudinal direction of the developing sleeve 44*a*, and correspond to areas out of the maximum-size image area. The second areas N of the developing sleeve 44*a* do not have concave and convex portions unlike the first area M, and the surface of the second areas N is a smooth cylindrical surface. The magnet roll 44*b* disposed inside the developing sleeve 44*a* extends at least across the length of the first area M, for allowing the first area M to bear the developer. Note that although one end portion of the magnet roll 44*b* is generally located in one portion of the second areas N, it is difficult for the one end portion of the magnet roll 44*b* to produce the magnetic field that allows the developing sleeve 44*a* to bear the developer. This is because the one end portion of the magnet roll 44*b* produces rippled magnetic flux density.

Since the developer is hardly borne by the second areas N formed at both end portions of the developing sleeve 44*a*, the air easily passes through a space around the second areas N of the developing sleeve 44*a*. Since the developer of the developer container 41 is not supplied to the second areas N of the developing sleeve 44*a*, there is almost no developer on the surface of the second areas N. Thus, there is no developer also in the clearance between the second areas N of the developing sleeve 44*a* and the photosensitive drum 1A. Consequently, in the second areas N, the air can flow through a space located upstream of the closest position Pin the rotational direction of the developing sleeve 44*a* and through a space located downstream of the closest position P in the rotational direction of the developing sleeve 44*a*.

In contrast, in the first area M of the developing sleeve 44*a*, the developer is borne by the surface of the first area M, and the clearance between the developing sleeve 44*a* and the photosensitive drum 1A is blocked with the developer, as illustrated in FIG. 3. Consequently, in the first area, the air hardly flows through a space located upstream of the closest position P in the rotational direction of the developing sleeve 44*a* and through a space located downstream of the closest position P in the rotational direction of the developing sleeve 44*a*.

Thus, the air flows into the inflow opening portion 50 that faces the other end portion of the developing sleeve 44*a* in the longitudinal direction of the developing sleeve 44*a*, then flows through a space around the second area N, and then flows into the airflow space portion 52. In addition, since the developing sleeve 44*a* rotates, the air having flown into the inflow opening portion 50 is easily sent to the airflow space portion 52, which is located downstream of the inflow opening portion 50 in the rotational direction of the developing sleeve 44*a*.

Scattering of Toner

Figure 4:
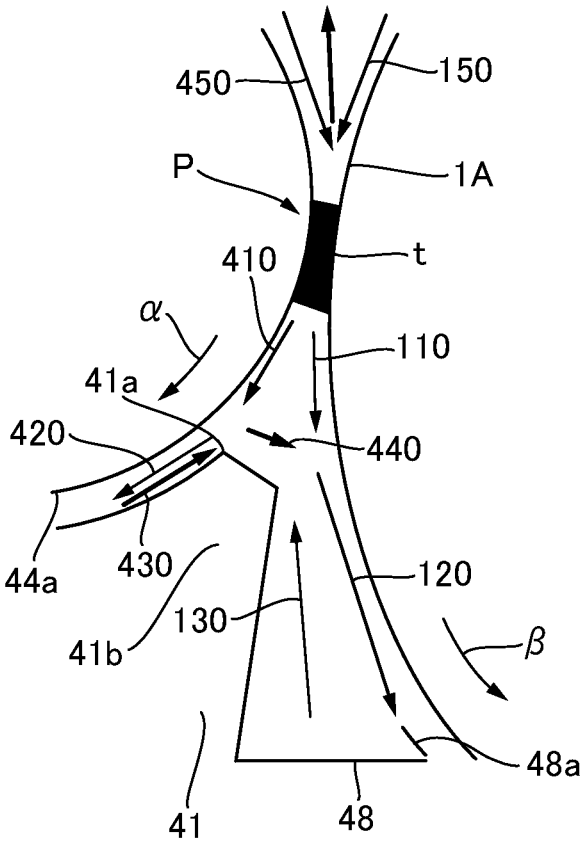
FIG. 4 is a cross-sectional view of a closest position between a developing sleeve and a photosensitive drum and its surroundings, taken along the broken line A of FIG. 2.

Next, the airflow and the scattering toner produced between the developing apparatus 4A and the photosensitive drum 1A when the developing apparatus 4A and the photosensitive drum 1A are driven will be described with reference to FIGS. 4 and 5. FIG. 4 illustrates a cross section of a center portion (indicated by the broken line A of FIG. 2) of the developing apparatus 4A, located at a center of the developing apparatus 4A in the longitudinal direction. In the cross section, FIG. 4 illustrates the flow of air and the flow of toner that are produced between the developing apparatus 4A and the photosensitive drum 1A. In FIG. 4, solid line arrows indicate directions of scattering toner.

When driven, the developing sleeve 44*a* and the photosensitive drum 1A generate airflow on the surface of the developing sleeve 44*a* and the photosensitive drum 1A. The airflow on the surface of the developing sleeve 44*a* is sleeve flows 410 and 420, and the airflow on the surface of the photosensitive drum 1A is drum flows 110 and 120. The sleeve flow 420 enters the developer container 41 and increases the air pressure of the developer container 41, so that an airflow 430 is generated and flows from the developer container 41 toward the outside of the developer container 41. As a result, the developer (toner) of the developer container 41 is carried by the airflow 430, and flows out of the developer container 41. The toner is then carried by an airflow 440, and scatters along the drum flow 120, as scattering toner.

As described above, the airflow space portion 52 is formed downstream of the developing nip portion and enclosed by the developer container 41, the developing sleeve 44*a*, the photosensitive drum 1A, the projection portion 48, and the end-portion ribs 49*a* and 49*b*. Thus, a return flow 130 is produced from the drum flow, and one portion of the scattering toner is carried by the return flow 130 and collected by the developing sleeve 44*a*.

Most of the scattering toner is received by the projection portion 48, and stays on the projection portion 48. However, if the amount of scattering toner is large, the scattering toner accumulates on the projection portion 48 as image forming operations are successively performed. If the amount of toner exceeds the capacity of the projection portion 48, the toner scatters to the outside and causes dirt of the interior of the image forming apparatus and of rollers that convey recording materials. If the toner sticks to a roller, the toner on the roller will also stick to a recording material conveyed by the roller, and cause image defects.

Note that a sleeve flow and a drum flow are generated also in a space located upstream of the developing nip portion, and in FIG. 4, a sleeve flow 450 and a drum flow 150 are illustrated. However, since there is the developer in the developing nip portion formed on the first area, the sleeve flow 450 and the drum flow 150 do not flow into a space located downstream of the developing nip portion, and become a return flow as indicated by an arrow.

Figure 5:
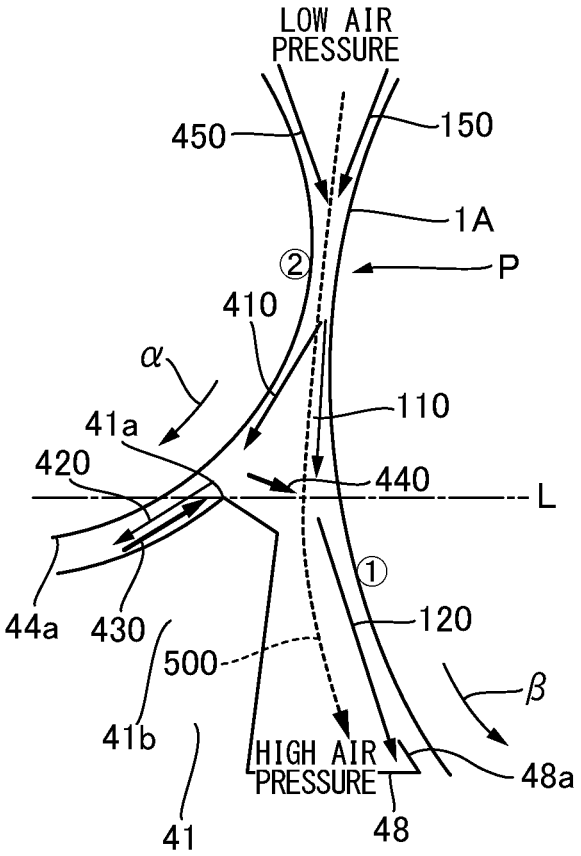
FIG. 5 is a cross-sectional view of the closest position between the developing sleeve and the photosensitive drum and its surroundings, taken along a broken line B of FIG. 2.

FIG. 5 illustrates a cross section of a second area of an end portion (indicated by a broken line B of FIG. 2) of the developing apparatus 4A, located in the longitudinal direction. In the cross section, FIG. 5 illustrates the flow of air and the flow of toner that are produced between the developing apparatus 4A and the photosensitive drum 1A. In FIG. 5, solid line arrows indicate directions of scattering toner, and a dotted line arrow indicates a composite airflow made up of component airflows. In FIG. 5, since there is no developer on the developing sleeve 44*a* unlike FIG. 4, the amount of toner contained in the air flow is very small. In addition, since there is no developer in the developing nip portion, the airflow passes through the developing nip portion such that the air flows from a space located upstream of the developing nip portion, directly to a space located downstream of the developing nip portion. Thus, a composite airflow 500 indicated by the dotted line arrow is generated, decreasing the air pressure of the space located upstream of the developing nip portion and increasing the air pressure of the space located downstream of the developing nip portion.

As described above, since the inflow opening portion 50 is formed in an end portion, such as the front end portion, of the developer container 41 located upstream of the developing nip portion in the rotational direction of the developing sleeve 44*a*, the air easily flows through the inflow opening portion 50 into the portion located upstream of the developing nip portion, which has a negative pressure. The air that has flown into the front end portion of the developer container 41 flows into the airflow space portion 52 along the composite airflow 500.

As described above, in the front end portion of the developing apparatus 4A located in the longitudinal direction, the above-described sleeve flow and drum flow cause the air to flow into the airflow space portion 52 through the inflow opening portion 50. The air then flows from the front side to the back side in the airflow space portion 52. When the air flows in the airflow space portion 52, the air catches and collects the above-described scattering toner. Then the air that contains the scattering toner is drawn into the drawing opening portion 51 in the back side of the airflow space portion 52. The air is then drawn into the duct 53 connected to the drawing fan 70 (FIG. 7), and discharged to the outside of the image forming apparatus 100, as described later.

As previously described, the developing apparatus 4A is a function-separated developing apparatus. Thus, in the second developer-conveyance path 45*b* of the function-separated developing apparatus, the density of developer in the air, caused by the second screw 46*b* throwing up the developer, becomes larger in the downstream portion of the second developer-conveyance path 45*b*, which is located in the developer conveyance direction and has a lower developer surface. In addition, in the downstream portion of the second developer-conveyance path 45*b*, since the amount of airflow caused by driving the developing sleeve 44*a* increases, the amount of scattering toner tends to increase.

For this reason, in the first embodiment, the drawing opening portion 51 is disposed on the downstream side of the second developer-conveyance path 45*b* in the developer conveyance direction (i.e., back end portion of the developing apparatus 4A in the longitudinal direction), on which side the amount of scattering toner tends to increase because the height of the developer surface is low. With this arrangement, the toner that scatters through the clearance between the developer container 41 and the developing sleeve 44*a* can be more effectively drawn into the drawing opening portion 51 and collected in the back end portion of the developing apparatus 4A in the longitudinal direction.

Cooling Configuration of Developing Apparatus

Next, a cooling configuration of the developing apparatus 4A of the present embodiment will be described. By the way, as the operation speed of image forming apparatuses has been increased in recent years, the speed of agitating the developer of the developing apparatus has also increased. As a result, the temperature of the toner increases, deteriorating the property of toner of being charged and causing image defects. Thus, in the present embodiment, the developing apparatus 4A includes a cooling duct 55 through which air flows for cooling the developing apparatus 4A. The cooling duct 55 serves as a second airflow space portion.

As illustrated in FIGS. 2, 3, 6, and 7, the cooling duct 55 is disposed outside the developer container 41 and extends along the longitudinal direction of the developer container 41. Specifically, the cooling duct 55 is disposed on a side (back surface side) opposite to the side on which the developing sleeve 44*a* is disposed, for allowing the air to flow through the cooling duct 55. That is, the cooling duct 55 is a duct that is disposed on a side opposite to the side on which the developer container 41 faces the photosensitive drum 1A, that extends from one end side to the other end side of the developing sleeve 44*a* in the rotation-axis direction of the developing sleeve 44*a*, and that forms a flow path of air for cooling the developer container 41. As illustrated in FIG. 2, an inflow opening portion 54 is formed in the other end portion (front end portion) of the cooling duct 55 in the longitudinal direction for sending air into the cooling duct 55, and a discharging opening portion 56 is formed in one end portion (back end portion) of the cooling duct 55 in the longitudinal direction for discharging the air from the cooling duct 55.

In addition, as illustrated in FIG. 3, a plurality of heat dissipating plates 111 is disposed in the cooling duct 55. The heat dissipating plates 111 extend along the longitudinal direction of the cooling duct 55, almost in parallel with each other. Specifically, the plurality of heat dissipating plates 111 is disposed on one portion of the cooling duct 55 on the back surface side of the developer container 41, and are formed like ribs that extend in parallel with a direction in which the cooling wind flows in the cooling duct 55. The heat dissipating plates 111 are made of a material, such as an aluminum alloy (A6063), that has high thermal conductivity. Since the surface area of the heat dissipating plates 111, which contacts the cooling wind, is increased in this manner, the cooling efficiency can be increased.

As illustrated in FIG. 2, an airflow discharging portion 57 is connected to one end portion of the cooling duct 55 in the longitudinal direction, for discharging the air. The airflow discharging portion 57 serves as a discharging portion. The discharging opening portion 56 of the cooling duct 55 is opened to the airflow discharging portion 57, and the air that flows through the cooling duct 55 flows into the airflow discharging portion 57. In addition, as illustrated in FIG. 7, a cooling fan 67 is disposed upstream of the other end portion of the cooling duct 55 in the longitudinal direction of the cooling duct 55, that is, in a direction in which the air flows. The cooling fan 67 sends air into the cooling duct 55. Specifically, the cooling fan 67 is connected to the inflow opening portion 54 of the cooling duct 55, and sends air into the cooling duct 55 through the inflow opening portion 54.

Drawing of Scattering Toner and Cooling of Developing Apparatus

Figure 11:
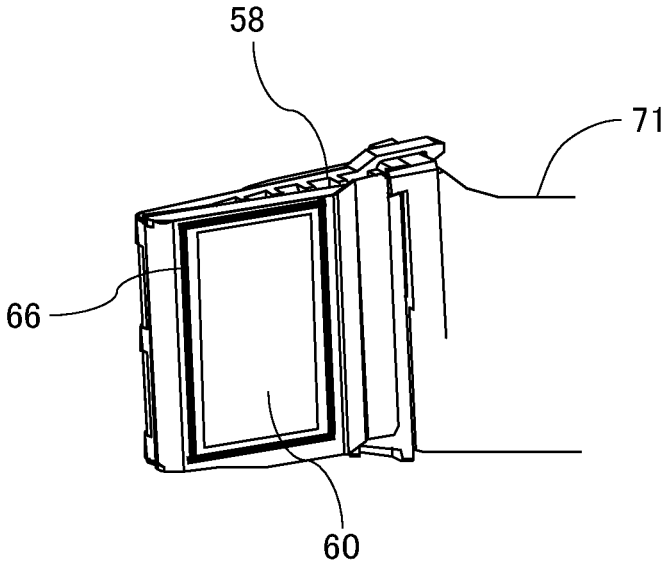
FIG. 11 is a perspective view of a connection portion of an air discharging duct of the first embodiment, via which the air discharging duct and the developing apparatus are connected with each other.

In the present embodiment, the airflow space portion 52 in which the air flows for collecting the scattering toner as described above and the cooling duct 55 in which the air flows for cooling the developing apparatus 4A join each other in the airflow discharging portion 57. As illustrated in FIG. 11 described later, the airflow discharging portion 57 is connected to an air discharging duct 71 disposed in the apparatus body of the image forming apparatus 100. Thus, the air that flows in the airflow space portion 52 and the air that flows in the cooling duct 55 flow in the air discharging duct 71. The air discharging duct 71 is provided with the drawing fan 70 (FIG. 7). Thus, the air of the air discharging duct 71 is drawn by the drawing fan 70, and discharged to the outside of the image forming apparatus 100 through a filter (not illustrated).

Figure 6:
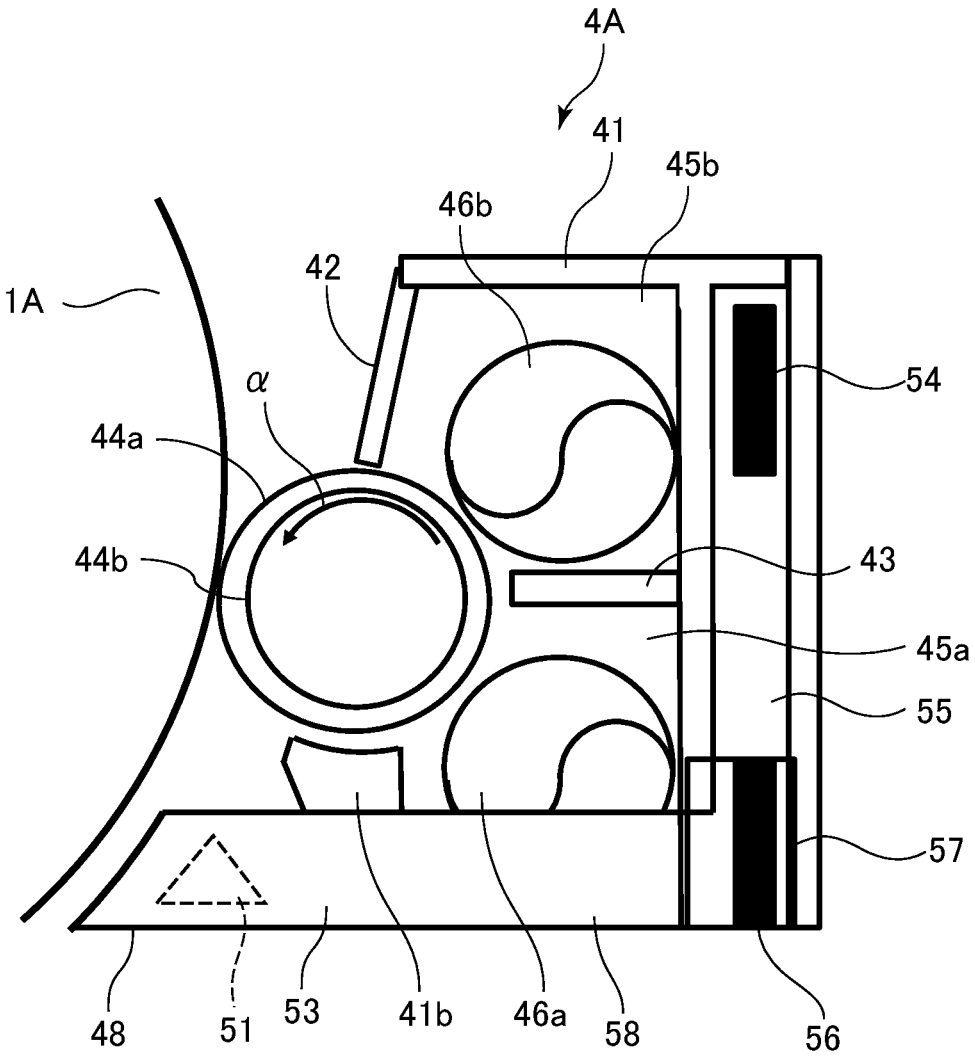
FIG. 6 is a partial cross-sectional view as viewed from a back right side of FIG. 2.

Hereinafter, the detailed description thereof will be made. As illustrated in FIG. 6, the inflow opening portion 54 is disposed at an upper position in the up and down direction of the cooling duct 55, whereas the discharging opening portion 56 is disposed at a lower position in the up and down direction of the cooling duct 55. In the present embodiment, the airflow discharging portion 57 to which the discharging opening portion 56 is opened is also disposed at a position closer to the lower edge portion of the developer container 41. In addition, the duct 53 is disposed as a communication duct, and connected to the airflow discharging portion 57. The drawing opening portion 51 of the airflow space portion 52 is opened to the duct 53. That is, as illustrated in FIGS. 6 and 8, the duct 53 is an airflow connection portion disposed from the developing sleeve 44*a* side to the back surface side of the developer container 41 underneath the developer container 41 so as to run around the developing sleeve 44*a*, and connected to the airflow discharging portion 57 disposed on the back surface side of the developer container 41. In other words, the duct 53 is connected with the airflow space portion 52 so that the air can flow between the airflow space portion 52 and the duct 53, and the duct 53 connects the drawing opening portion 51 and the airflow discharging portion 57 so that the air can flow between the drawing opening portion 51 and the airflow discharging portion 57. Note that in the first embodiment, the duct 53 causes the airflow discharging portion 57, the drawing opening portion 51, and the cooling duct 55 to communicate with each other. In addition, although the developer container 41 and the duct 53 are integrated with each other in the first embodiment, the developer container 41 and the duct 53 may be separate members in a modification. In addition, the duct 53 may not be limited to a fully enclosed space, and may be a substantially enclosed space that allows the air to flow between the drawing opening portion 51 and the airflow discharging portion 57.

Figure 9:
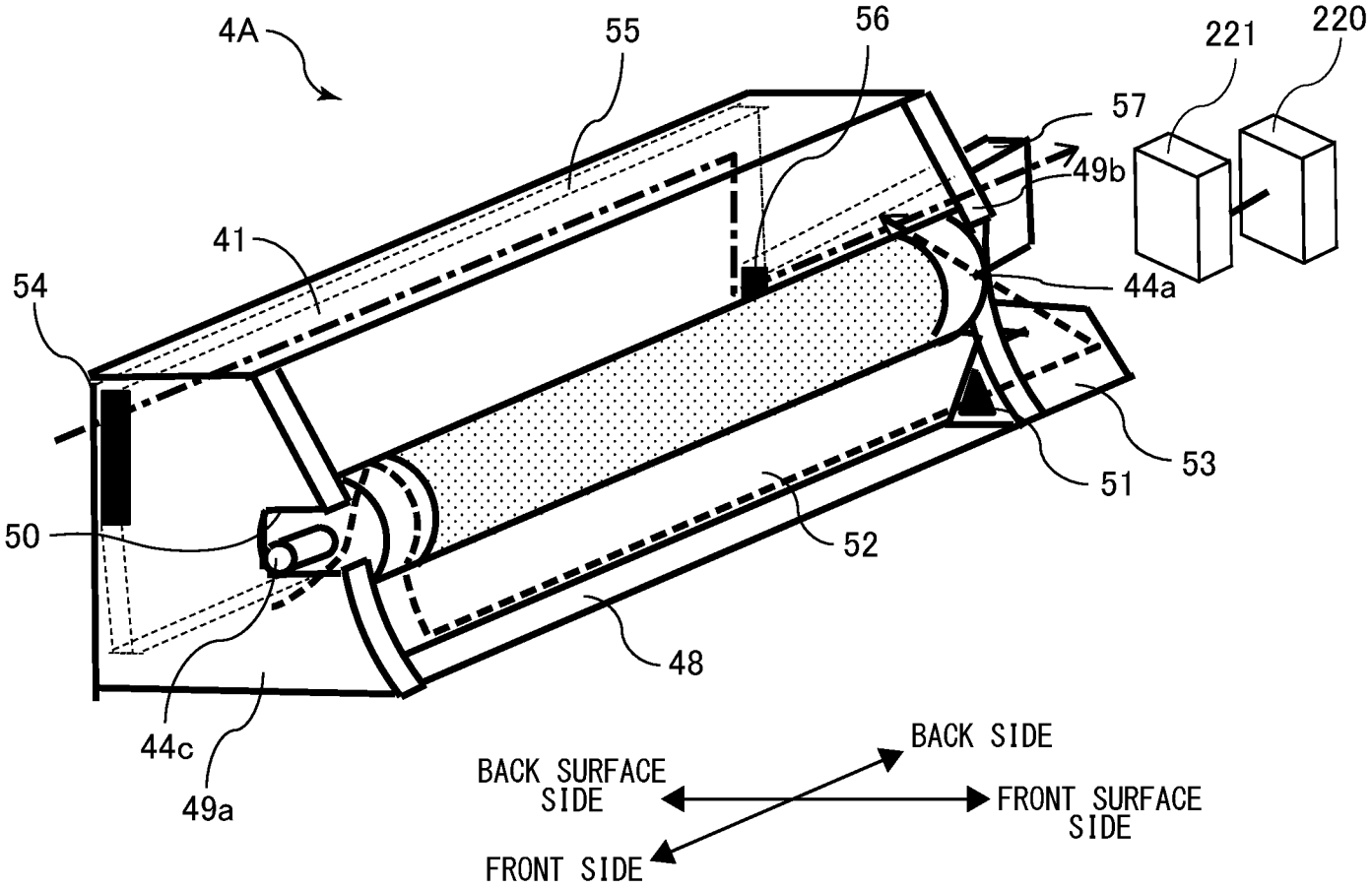
FIG. 9 is a perspective view of the developing apparatus of the first embodiment that illustrates airflow in the interior of the developing apparatus.

Next, a positional relationship between the airflow space portion 52, the inflow opening portion 50, the drawing opening portion 51, the airflow discharging portion 57, the drawing fan 70, the driving-force transmission member 211, and the driving device 210 will be described with reference to FIG. 9. As illustrated in FIG. 9, a side on which the developer container 41 faces the photosensitive drum 1A is defined as a front surface side of the developer container 41, and a side opposite to the side on which the developer container 41 faces the photosensitive drum 1A is defined as a back surface side of the developer container 41. In addition, as illustrated in FIG. 9, the other end side of the developing sleeve 44*a* in the longitudinal direction is defined as a front side of the developer container 41, and one end side of the developing sleeve 44*a* in the longitudinal direction is defined as a back side of the developer container 41. Thus, the other end side of the developing sleeve 44*a* in the rotation-axis direction is located upstream of the first area M in the first direction, and the one end side of the developing sleeve 44*a* in the rotation-axis direction is located downstream of the first area M in the first direction. As described above, the first direction is a direction in which the second screw 46*b* conveys the developer.

The airflow space portion 52 is formed on the front surface side of the developer container 41, along the longitudinal direction of the developing apparatus 4A (i.e., rotation-axis direction of the developing sleeve 44*a*). The inflow opening portion 50 is disposed on the front surface side and the front side of the developer container 41. The drawing opening portion 51 is disposed on the front surface side and the back side of the developer container 41. The airflow discharging portion 57 is disposed on the back surface side and the back side of the developer container 41.

The drawing fan 70 is disposed on the back surface side and the back side of the developer container 41. The driving-force transmission member 211 is disposed on the front surface side and the back side of the developer container 41. The driving device 210 is disposed on the front surface side and the back side of the developer container 41.

As previously described, in the first embodiment, the scattering toner is carried by the airflow in the airflow space portion 52, and collected through the airflow discharging portion 57. In the configuration of the first embodiment, the airflow space portion 52, the driving-force transmission member 221, and the driving device 220 are disposed on the front surface side of the developer container 41. In such a configuration, if the airflow discharging portion 57 is disposed on the front surface side and the back side of the developer container 41, a space to dispose the drawing fan 70 on the front surface side of the developer container 41 has to be secured in the developing apparatus such that the drawing fan 70 does not interfere with the driving-force transmission member 211 and the driving device 210 disposed on the front surface side and the back side of the developer container 41.

In the first embodiment, however, the duct (airflow connection portion) 53 is disposed from the developing sleeve 44*a* side to the back surface side of the developer container 41 underneath the developer container 41 so as to run around the developing sleeve 44*a*. The duct 32 connects the drawing opening portion 51 and the airflow discharging portion 57 so that the air flows between the drawing opening portion 51 and the airflow discharging portion 57. Since the arrangement of the duct 53 allows the airflow discharging portion 57 to be disposed on the back surface side of the developer container 41, the drawing fan 70 can also be disposed on the back surface side of the developer container 41.

That is, in the first embodiment, the drawing fan 70 can be disposed on the side (i.e., back surface side of the developer container 41) opposite to the side (i.e., front surface side of the developer container 41) on which the airflow space portion 52, the driving-force transmission member 221, and the driving device 220 are disposed. Thus, it is not necessary to secure the space to dispose the drawing fan 70 on the front surface side of the developer container 41, and thus the developing apparatus can be prevented from being increased in size.

Figure 10:
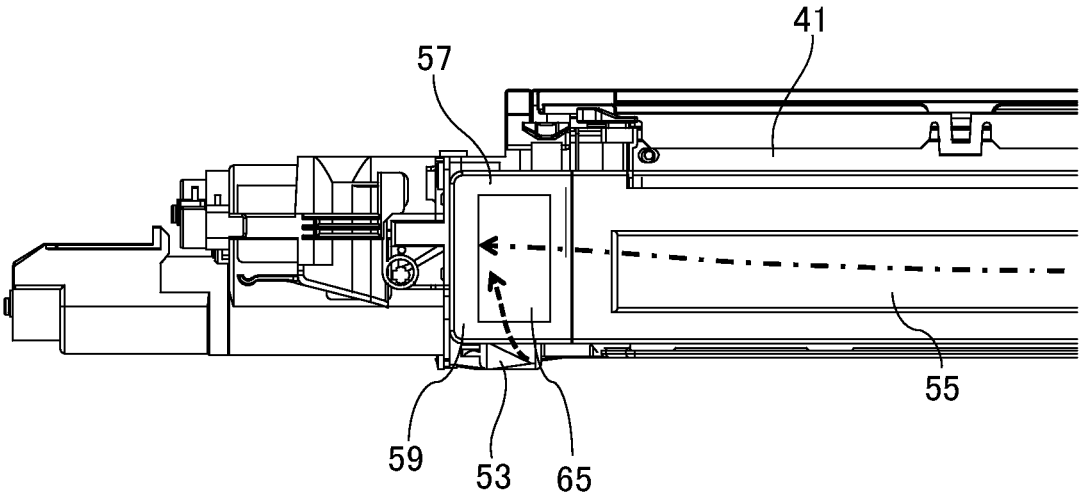
FIG. 10 is a plan view of an outlet of the developing apparatus of the first embodiment and its surroundings.

Note that in FIG. 2 described above and FIG. 9 described later, the duct 53 is illustrated to extend from the drawing opening portion 51 in the longitudinal direction, for simplifying the description. In the present embodiment, however, the duct 53 is disposed underneath the developer container 41, as illustrated in FIGS. 8 and 10. Since the duct 53 is disposed in this manner, the size of the developing apparatus can be reduced in the longitudinal direction. However, the duct 53 may not be disposed in this manner. As illustrated in FIGS. 2 and 9, the duct 53 may extend in the longitudinal direction, and be bent and connected to the airflow discharging portion 57 disposed on the back surface side of the developer container 41. In addition, FIGS. 2 and 9 and FIGS. 7 and 10 are different in position of the airflow discharging portion 57. In the present embodiment, the airflow discharging portion 57 is positioned as illustrated in FIGS. 7 and 10. However, the position of the airflow discharging portion 57 is also not limited to the position illustrated in FIGS. 7 and 10, and may be the position illustrated in FIGS. 2 and 9.

FIG. 8 is a perspective view of the developer container 41 viewed from the front surface side of the developing sleeve 44*a*, and a broken line arrow indicates the flow of air that has been drawn through the drawing opening portion 51. As indicated by the broken line arrow of FIG. 8, the air drawn through the drawing opening portion 51 flows through the duct 53 directly downstream in the longitudinal direction, and is then guided by the duct 53 so as to flow from the front surface side of the developer container 41 toward the back surface side of the developer container 41 underneath the first developer-conveyance path 45*a* (see FIG. 6). Then, as indicated by a broken line of FIG. 9, the air flows into the airflow discharging portion 57 disposed on the back surface side of the developer container 41.

On the other hand, the air sent from the cooling fan 67 as illustrated in FIG. 7 and drawn through the inflow opening portion 54 flows through the cooling duct 55, as indicated by a chain line of FIG. 9, disposed on the back surface side of the developer container 41; and cools the developing apparatus 4A. Then the air flows through the discharging opening portion 56 into the airflow discharging portion 57. In this manner, the air that contains the scattering toner and that flows through the airflow space portion 52 and is drawn through the drawing opening portion 51, and the air that flows through the cooling duct 55 for cooling the developing apparatus 4A and is drawn through the discharging opening portion 56 join each other in the airflow discharging portion 57.

Connection between Airflow Discharging Portion and Main-Body-Side Duct

The resultant airflow into which the two airflows have joined each other in the airflow discharging portion 57 as described above is sent to the main-body-side air discharging duct 71. In the present embodiment, as illustrated in FIG. 10, the airflow discharging portion 57 includes a single outlet (i.e., an opening portion of the duct) 65 that discharges the resultant airflow. Note that since the single outlet 65 has only to be an opening portion that discharges the resultant airflow into which the two airflows have joined each other in the airflow discharging portion 57, the outlet 65 may be provided with a partition plate or a louver. The main-body-side air discharging duct 71 illustrated in FIG. 11 is connected to the airflow discharging portion 57 so that the air drawn by the drawing fan 70 through the outlet 65 flows in the main-body-side air discharging duct 71. Hereinafter, a configuration of a connection portion between the airflow discharging portion 57 and the main-body-side air discharging duct 71 will be described with reference to FIGS. 10 to 12.

FIG. 10 is a diagram of the developer container 41 viewed from the back surface side of the developer container 41. A broken line arrow indicates the flow of air that is drawn from the airflow space portion 52 into the airflow discharging portion 57 through the duct 53. An alternate long and short dashed line arrow indicates the flow of air that is drawn from the cooling duct 55 into the airflow discharging portion 57. The airflow discharging portion 57 includes a developing-apparatus-side connection portion 59 that is connected to a main-body-side connection portion 58 of the main-body-side air discharging duct 71 for sending air to the main-body-side air discharging duct 71. The developing-apparatus-side connection portion 59 is an area that is connected to the main-body-side connection portion 58. More specifically, the developing-apparatus-side connection portion 59 is an area that is in contact with the main-body-side connection portion 58. Thus, the airflow discharging portion 57 includes the developing-apparatus-side connection portion 59 that is connected to the main-body-side air discharging duct 71, and the developing-apparatus-side connection portion 59 has the single outlet 65. The airflow to collect the scattering toner and the airflow to cool the developing apparatus 4A join each other in the airflow discharging portion 57, and are discharged from the outlet 65.

FIG. 11 is a diagram of the main-body-side connection portion 58 of the air discharging duct 71 disposed in the main body of the image forming apparatus, viewed from diagonally above the surface of the main-body-side connection portion 58 that is connected with the developing-apparatus-side connection portion 59 of the airflow discharging portion 57. The main-body-side connection portion 58 is connected with the developing-apparatus-side connection portion 59. The main-body-side connection portion 58 includes a single inlet 60 through which the air drawn from the outlet 65 of the airflow discharging portion 57 is drawn. The inlet 60 is formed in a position in which the inlet 60 overlaps with the outlet 65 when the main-body-side connection portion 58 is connected with the developing-apparatus-side connection portion 59. In this position, the inlet 60 takes in the air discharged from the outlet 65. In the present embodiment, a sealing member 66 made of urethane foam or the like is disposed around the inlet 60 of the main-body-side connection portion 58. The sealing member 66 sufficiently seals the gap between the developing-apparatus-side connection portion 59 and the main-body-side connection portion 58.

Figure 12:
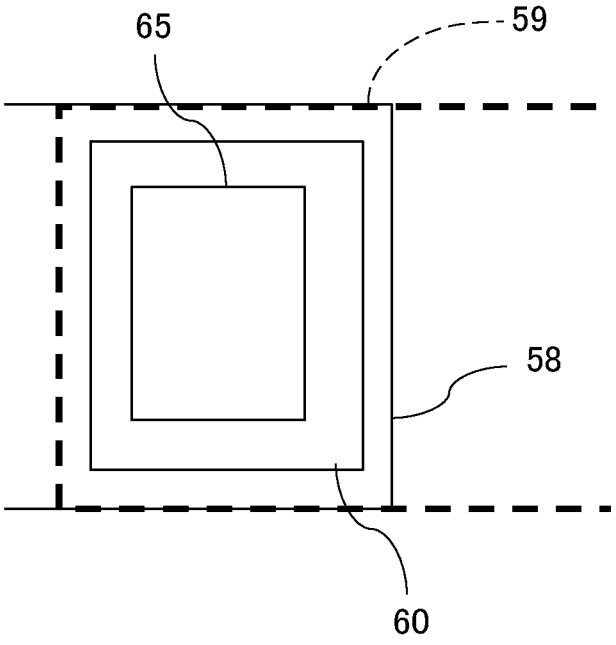
FIG. 12 illustrates a relationship between an inlet of the air discharging duct and the outlet of the developing apparatus of the first embodiment.

The degree of overlap between the inlet 60 and the outlet 65 is acceptable if the inlet 60 covers about 80% or more of the outlet 65. More preferably, the inlet 60 covers 90% or more or the whole of the outlet 65. FIG. 12 is a schematic diagram illustrating the degree of overlap between the inlet 60 and the outlet 65. As illustrated in FIG. 12, in the present embodiment, the inlet 60 has a larger area than that of the outlet 65, and covers the whole of the outlet 65 when the main-body-side connection portion 58 is connected with the developing-apparatus-side connection portion 59.

The drawing opening portion 51 is a trapezoid having a lower base of 9.2 mm, an upper base of 5.2 mm, and a height of 5.9 mm; the inflow opening portion 54 is a rectangle having a size of 10.5×20.1 mm; and the discharging opening portion 56 is a rectangle having a size of 10.5×15 mm. The outlet 65 is a rectangle having a size of 30×12.5 mm, and the inlet 60 is a rectangle having a size of 36×17 mm.

As described above, the air sent to the inlet 60, which is disposed on the main body side, and containing the scattering toner and the air drawn through the inflow opening portion 54 and used for cooling the developing apparatus 4A flow together in the air discharging duct 71 of the main body with the action of the identical drawing fan 70 (FIG. 7). Then, the air that contains the scattering toner and the air that cools the developing apparatus 4A are discharged to the outside of the image forming apparatus through a toner filter (not illustrated) disposed in the image forming apparatus. The drawing fan 70 is disposed downstream of the toner filter. In the present embodiment, each of the drawing fan 70 and the cooling fan 67 (FIG. 7), which sends air into the inflow opening portion 54, is a sirocco fan.

As described above, in the first embodiment, the drawing fan 70 is disposed on the side (i.e., back surface side of the developer container 41) opposite to the side (i.e., front surface side of the developer container 41) on which the airflow space portion 52, the driving-force transmission member 221, and the driving device 220 are disposed. With this arrangement, it is not necessary to secure the space to dispose the drawing fan 70 on the front surface side of the developer container 41, and thus the developing apparatus can be prevented from being increased in size.

In addition, in the present embodiment, the above-described configuration can prevent the developing apparatus 4A from being increased in size, even if the developing apparatus 4A includes both of the airflow space portion 52 to collect the scattering toner and the cooling duct 55 to cool the developing apparatus 4A. That is, in the present embodiment, the air to collect the scattering toner and the air to cool the developing apparatus 4A join each other in the single outlet 65, and are discharged to the outside of the image forming apparatus through the air discharging duct 71. Thus, the scattering toner and the toner deterioration can be prevented without the need of disposing a plurality of main-body-side connection portions and a plurality of developing-apparatus-side connection portions, and without increasing the size of the main body and costs.

Note that although the above description has been made for the case where the clearance is formed between the end-portion ribs 49*a* and 49*b* and the photosensitive drum 1A, the clearance may not be formed. For example, the end-portion rib 49*a* that serves as a first end-portion projection portion and the end-portion rib 49*b* that serves as a second end-portion projection portion may be each provided with an elastic member that elastically contacts the photosensitive drum 1A. The elastic member may be a porous member, such as a sponge, made of urethane, a nonwoven fabric, or a sheet-like member. Examples of the sheet-like member include a PET (polyethylene terephthalate) sheet and a urethane sheet.

In addition, although the above description has been made for the case where the inflow opening portion 50 is formed in the end-portion rib 49*a* alone, the inflow opening portion 50 may be formed also in the end-portion rib 49*b*. That is, the inflow opening portion 50 may be formed in both of the end-portion ribs 49*a* and 49*b*. The inflow opening portion 50 formed in the end-portion rib 49*b* may be the same as the inflow opening portion 50 formed in the end-portion rib 49*a*, in shape and position in the rotational direction of the developing sleeve 44*a*.

The airflow in the airflow space portion 52 is mainly produced from air that flows into the airflow space portion 52 through the inflow opening portion 50. In addition to this, the airflow may be produced from air that flows into the airflow space portion 52 through the clearance between the projection portion 48 and the photosensitive drum 1A. That is, the airflow space portion 52 is not limited to a fully enclosed space, and may be a substantially enclosed space in which the airflow can be produced. Thus, the air may flow into the airflow space portion 52 through the clearance between the projection portion 48 and the photosensitive drum 1A.

Second Embodiment

Figure 13:
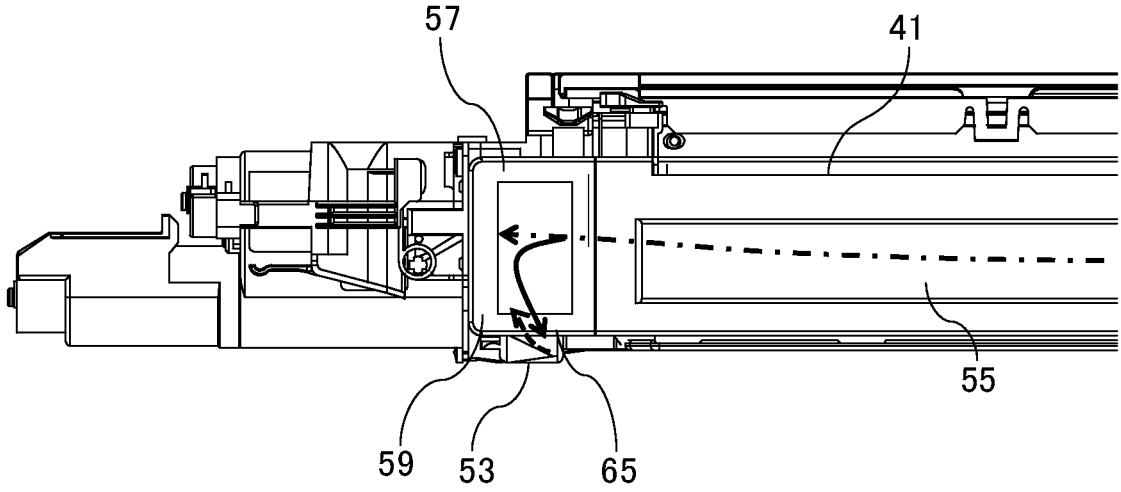
FIG. 13 illustrates air drawn into the cooling duct and flowing backward in a connection duct.

Next, a second embodiment will be described with reference to FIGS. 13 to 15. In the above-described first embodiment, the airflow that contains the scattering toner and the airflow that cools the developing apparatus 4A join each other in the airflow discharging portion 57, and are sent from the single outlet 65 to the main-body-side air discharging duct 71. In the present embodiment, two outlets 65*a* and 65*b* are formed in an airflow discharging portion 57A for discharging corresponding two airflows. Since the other configuration and operation are the same as those of the first embodiment, a component identical to a component of the first embodiment is given an identical symbol, duplicated description and illustration will be omitted or simplified, and features different from the first embodiment will be mainly described below.

If the cooling fan 67 (FIG. 7) for forcing air to flow into the inflow opening portion 54 is disposed upstream of the inflow opening portion 54 as in the above-described first embodiment, the following problem may occur. As described above, the air that flows through the airflow space portion 52 and contains the scattering toner and the air that is forced to flow into the inflow opening portion 54 by the cooling fan 67 and flows through the cooling duct 55 join each other in the airflow discharging portion 57. However, as indicated by a solid line of FIG. 13, the air forced to flow into the inflow opening portion 54 by the cooling fan 67 may flow backward in the duct 53, from the airflow discharging portion 57 toward the drawing opening portion 51 (see FIG. 9, for example). If the air flows backward in the duct 53, the air that contains the scattering toner cannot be sufficiently drawn, and the scattering toner cannot be sufficiently reduced.

For reducing such a problem, in the present embodiment, the air that is drawn through the drawing opening portion 51 and contains the scattering toner and the air that passes through the cooling duct 55 are separately discharged. Also in the present embodiment, the airflow discharging portion 57A is disposed, and the two airflows are sent to the airflow discharging portion 57A. The airflow discharging portion 57A includes the outlet 65*a* and the outlet 65*b*. The outlet 65*a* serves as a first outlet, and discharges the air that flows through the airflow space portion 52 that serves as a first airflow space portion. The outlet 65*b* serves as a second outlet, and discharges the air that flows through the cooling duct 55 that serves as a second airflow space portion. Hereinafter, the detailed description thereof will be made.

Figure 14:
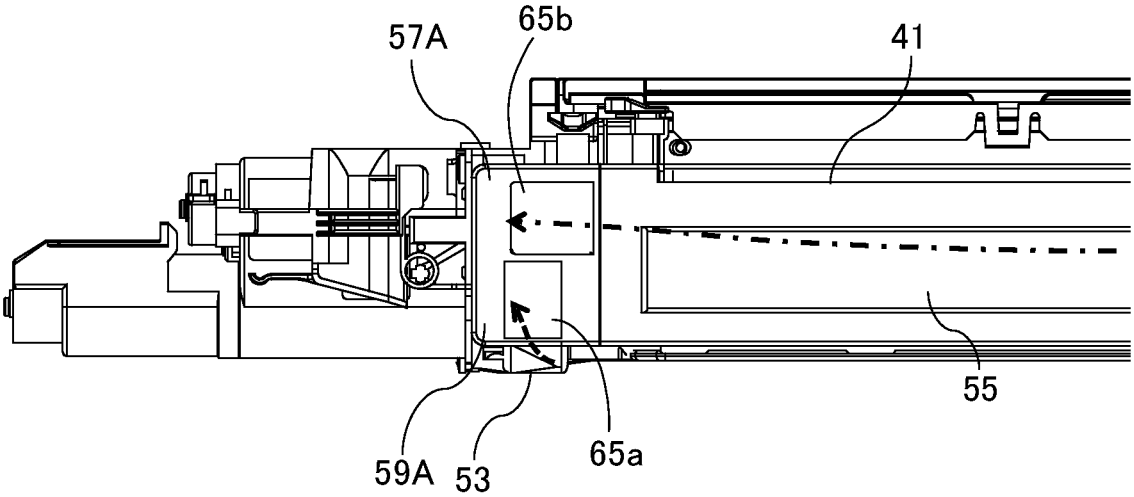
FIG. 14 is a plan view of an outlet of a developing apparatus of a second embodiment and its surroundings.
Figure 15:
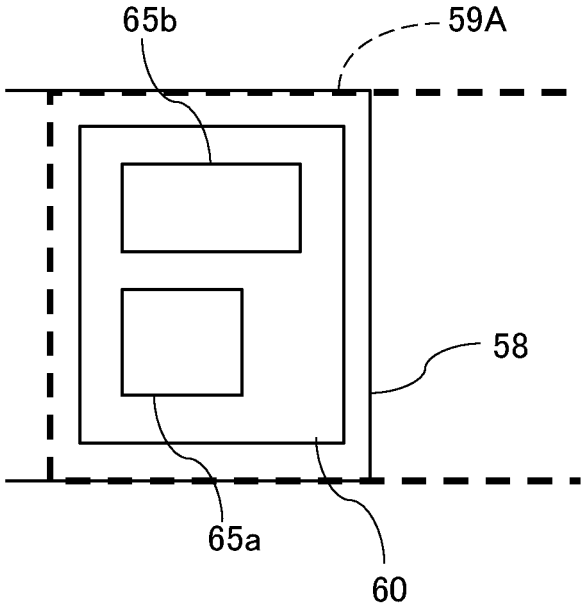
FIG. 15 illustrates a relationship between an inlet of an air discharging duct and first and second outlets of the developing apparatus of the second embodiment.

FIG. 14 is a diagram of the developer container 41 of the present embodiment, viewed from the back surface side. A broken line arrow indicates the flow of air that flows from the airflow space portion 52 into the airflow discharging portion 57A through the duct 53. An alternate long and short dashed line arrow indicates the flow of air that flows from the cooling duct 55 into the airflow discharging portion 57A. The airflow discharging portion 57A includes a developing-apparatus-side connection portion 59A that is connected to the main-body-side connection portion 58 of the main-body-side air discharging duct 71 for sending the air to the main-body-side air discharging duct 71.

Thus, the airflow discharging portion 57A of the present embodiment includes the developing-apparatus-side connection portion 59A that is connected to the main-body-side air discharging duct 71 (FIG. 11), and the developing-apparatus-side connection portion 59A has the two outlets 65*a* and 65*b*. The airflow to collect the scattering toner is discharged from the outlet 65*a* that serves as a first outlet, and the airflow to cool the developing apparatus 4A is discharged from the outlet 65*b* (i.e., an opening portion of the cooling duct) that serves as a second outlet. Specifically, the duct 53 is connected to the outlet 65*a* and the cooling duct 55 is connected to the outlet 65*b*, and the path in which the air flows through the duct 53 to the outlet 65*a* is different from the path in which the air flows through the cooling duct 55 to the outlet 65*b*.

As indicated by the broken line arrow of FIG. 8, the air drawn through the drawing opening portion 51 flows through the duct 53 directly downstream in the longitudinal direction, and is then guided by the duct 53 so as to flow from the front surface side of the developing apparatus 4A toward the back surface side underneath the first developer-conveyance path 45*a* (see FIG. 6, for example). As illustrated in FIG. 14, the air is then discharged from the outlet 65*a* of the airflow discharging portion 57A disposed on the back surface side of the developing apparatus 4A. On the other hand, the air sent by the cooling fan 67 into the inflow opening portion 54 directly flows through the cooling duct 55 disposed on the back surface side of the developing apparatus 4A, and is discharged from the outlet 65*b* of the airflow discharging portion 57A.

The two outlets 65*a* and 65*b* are disposed adjacent to each other. In the present embodiment, when the two outlets are disposed adjacent to each other, the distance between the two outlets is equal to or smaller than 50%, 10%, or 5% of a length of one side of a square whose area is equal to the area of smaller one of the two outlets. In addition, when the two outlets are disposed adjacent to each other, a projection such as a rib, a concave portion, or a hole that does not communicate with any of the first and the second airflow space portions may be formed between the two outlets.

In addition, when the two outlets are disposed adjacent to each other, the two outlets may be located in the same plane, or may be located in different planes. The different planes may be parallel with each other and shifted from each other in a direction in which the air flows, or may be inclined from each other. In the present embodiment, the two outlets 65*a* and 65*b* are located on the same plane as a plane in which the developing-apparatus-side connection portion 59A is located.

As in the first embodiment, the developing-apparatus-side connection portion 59A is connected to the main-body-side connection portion 58 disposed in the main body. The main-body-side connection portion 58 includes a single inlet 60 through which the air discharged from the two outlets 65*a* and 65*b* is drawn. The inlet 60 is formed in a position in which the inlet 60 overlaps with the two outlets 65*a* and 65*b* when the main-body-side connection portion 58 is connected with the developing-apparatus-side connection portion 59A. In this position, the inlet 60 collectively takes in the air discharged from the two outlets 65*a* and 65*b*. Also in the present embodiment, a sealing member 66 made of urethane foam or the like is disposed around the inlet 60 of the main-body-side connection portion 58.

The degree of overlap between the inlet 60 and the outlets 65*a* and 65*b* is acceptable if the inlet 60 covers about 80% or more of the total area of the outlets 65*a* and 65*b*. More preferably, the inlet 60 covers 90% or more or the whole of the outlets 65*a* and 65*b*. FIG. 15 is a schematic diagram illustrating the degree of overlap between the inlet 60 and the outlets 65*a* and 65*b*. As illustrated in FIG. 15, in the present embodiment, the inlet 60 has a larger area than the total area of the outlets 65*a* and 65*b*. In addition, the inlet 60 covers the whole of the outlets 65*a* and 65*b* when the main-body-side connection portion 58 is connected with the developing-apparatus-side connection portion 59A.

The drawing opening portion 51 is a trapezoid having a lower base of 9.2 mm, an upper base of 5.2 mm, and a height of 5.9 mm; the inflow opening portion 54 is a rectangle having a size of 10.5×20.1 mm; and the discharging opening portion 56 is a rectangle having a size of 10.5×15 mm. In addition, the outlet 65*a* is a rectangle having a size of 12.5×17.3 mm, and the outlet 65*b* is a rectangle having a size of 19.2×15.9 mm. The two outlets 65*a* and 65*b* are disposed, separated from each other by a distance of 2 mm. The inlet 60 is a rectangle having a size of 36×17 mm.

Also in the present embodiment, the air sent to the main-body-side inlet 60 and containing the scattering toner and the air drawn through the inflow opening portion 54 and used for cooling the developing apparatus 4A flow together in the air discharging duct 71 of the main body with the action of the identical drawing fan 70 (FIG. 7). Then, the air that contains the scattering toner and the air that cools the developing apparatus 4A are discharged to the outside of the image forming apparatus through a toner filter (not illustrated) disposed in the image forming apparatus. The drawing fan 70 is disposed downstream of the toner filter. In the present embodiment, each of the drawing fan 70 and the cooling fan 67 (FIG. 7), which sends air into the inflow opening portion 54, is a sirocco fan.

Also in the present embodiment, the above-described configuration can prevent the developing apparatus 4A from being increased in size, even if the developing apparatus 4A includes both of the airflow space portion 52 to collect the scattering toner and the cooling duct 55 to cool the developing apparatus 4A. In addition, in the present embodiment, the above-described two airflows are separately discharged from the two outlets 65*a* and 65*b*. Thus, even in the configuration in which the cooling fan 67 is disposed for sending air into the cooling duct 55, the air forced to flow into the cooling duct 55 by the cooling fan 67 can be suppressed from flowing backward in the duct 53, from the airflow discharging portion 57A toward the drawing opening portion 51.

Note that although the description has been made for the case where the single inlet 60 is disposed for taking in the air from the two outlets 65*a* and 65*b*, two inlets 60 may be disposed. That is, the two inlets 60 may be connected to the respective two outlets 65*a* and 65*b*. In this case, the main-body-side connection portion 58 may include an opening portion that covers the whole of the two outlets 65*a* and 65*b*, and the opening portion may be partitioned by a wall. The wall may extend across the length of the air discharging duct 71, or from the opening portion to a portion whose position is separated from the position of the opening portion by a predetermined distance.

Examples

Next, experimental results in Example 1 and Example 2 will be described. Example 1 has a configuration of the first embodiment, and Example 2 has a configuration of the second embodiment. In the experiment, the direction of airflow at the drawing opening portion 51 was studied in Example 1 and Example 2. Specifically, the cooling fan 67 was driven so as to send air at a predetermined airflow rate, and an airflow rate DUTY of air that was drawn by the drawing fan 70 and that flowed to the inlet 60 disposed in the main body, was changed. Under these conditions, the direction of airflow at the drawing opening portion 51 was studied. The drawing fan 70 used was a sirocco fan that is driven by a power supply that supplies a voltage of 24 V. Table 1 illustrates the results.

TABLE 1

| FAN Duty [%] | 0 | 10 | 20 | 30 | 40 | 50 | 60 | 70 | 80 | 90 | 100 |
|---|---|---|---|---|---|---|---|---|---|---|---|
| EXAMPLE 1 | OUT | OUT | OUT | OUT | IN | IN | IN | IN | IN | IN | IN |
| EXAMPLE 2 | OUT | OUT | IN | IN | IN | IN | IN | IN | IN | IN | IN |

In Table 1, "OUT" means that the air flowed backward in the duct 53 and flowed outward from the drawing opening portion 51. In addition, "IN" means that the air flowed inward from the drawing opening portion 51, in the duct 53. The "IN" and "OUT" were determined by placing an incense stick in the vicinity of the drawing opening portion 51 and observing the direction of smoke.

As can be seen from Table 1, in Example 1, as the airflow rate DUTY caused by the drawing fan 70 was decreased, the air was disturbed at the inlet 60, and flowed backward through the duct 53 and flowed outward from the drawing opening portion 51. In contrast, in Example 2, although the air flowed backward as in Example 1 when the airflow rate DUTY caused by the drawing fan 70 was decreased, the threshold was improved from 40% to 20%. Thus, it is understood that the configuration of Example 2 can suppress the air from flowing backward.

Third Embodiment

Next, a third embodiment will be described with reference to FIGS. 16 to 19. In the present embodiment, the output of the drawing fan 70 and the cooling fan 67 is controlled in the configuration of the first or the second embodiment. Since the other configuration and operation are the same as those of the first or the second embodiment, a component identical to a component of the first or the second embodiment is given an identical symbol, duplicated description and illustration will be omitted or simplified, and features different from the first or the second embodiment will be mainly described below.

By the way, for generating the airflow to collect the scattering toner and the airflow to cool the developing apparatus 4A in the developing apparatus 4A, a single drawing fan could be used. However, if the two airflows were generated by the single drawing fan, the single drawing fan would be increased in size. For this reason, in the present embodiment, the above-described two airflows are generated by using the two fans (drawing fan 70 and the cooling fan 67), as described in the first or the second embodiment.

However, as described in detail later, the output of at least one of the drawing fan 70 and the cooling fan 67 can be reduced, depending on the environment around the developing apparatus 4A. If the drawing fan 70 and the cooling fan 67 are driven so as to produce their maximum output power, the power consumption and the noise will increase. Thus, it is desired to reduce the power consumption and the noise by controlling the output of the drawing fan 70 and the cooling fan 67 in accordance with the environment around the developing apparatus 4A. In the present embodiment, the output of the drawing fan 70 and the cooling fan 67 is controlled in accordance with the environment around the developing apparatus 4A.

Figure 16:
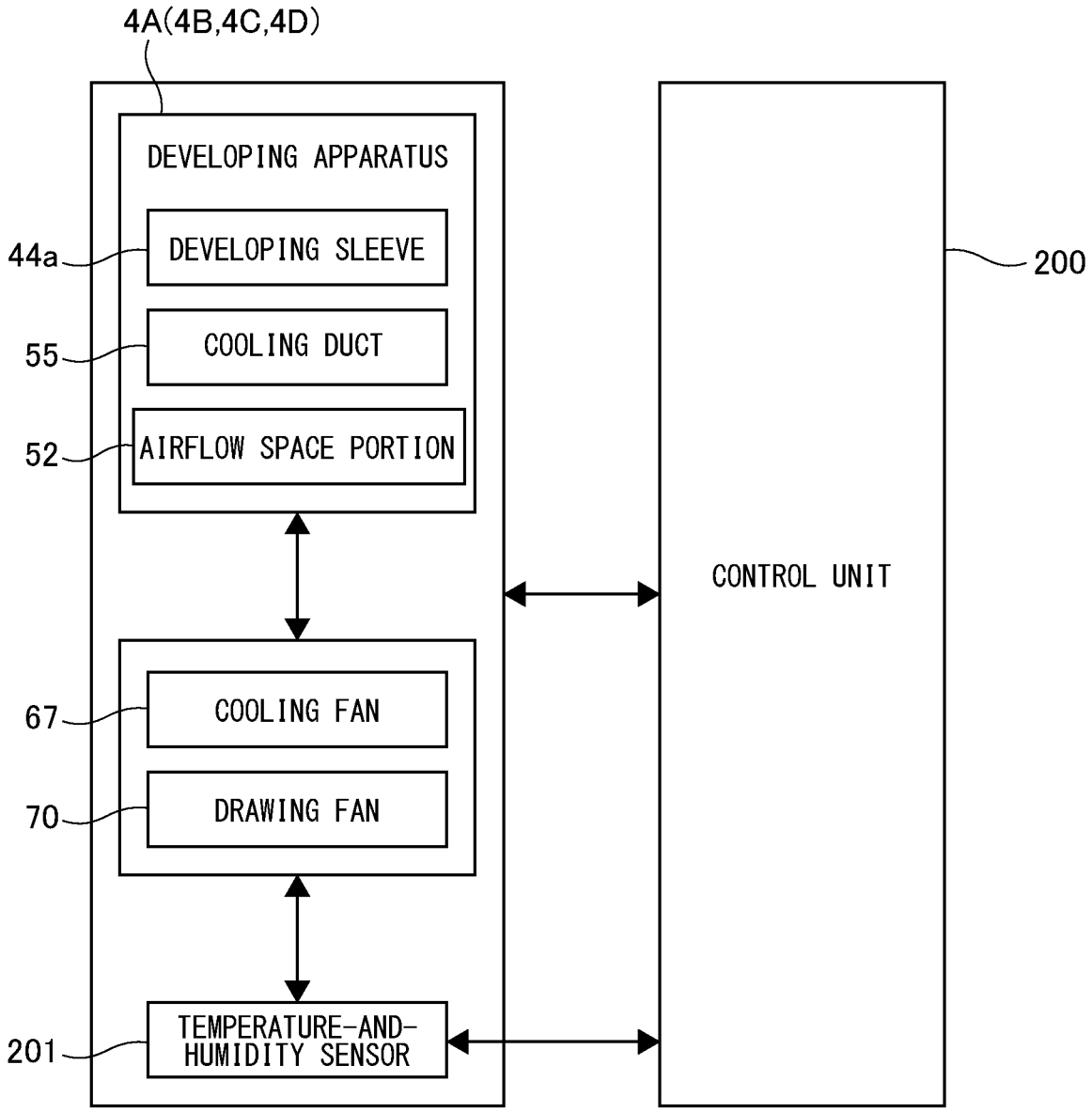
FIG. 16 is a block diagram illustrating control of output of a drawing fan and a cooling fan of a third embodiment.

FIG. 16 is a block diagram illustrating control of the output of the drawing fan 70 and the cooling fan 67 of the present embodiment. A control unit 200 controls the output of the drawing fan 70 and the cooling fan 67, and controls the whole of the image forming apparatus 100. The control unit 200 includes a central processing unit (CPU), a read only memory (ROM), and a random access memory (RAM). The CPU reads a program stored in the ROM and corresponding to a control procedure, and controls each component. The RAM stores work data and input data. The CPU refers to the data stored in the RAM, depending on the above-described program; and controls each component. Hereinafter, the control of the output of the drawing fan 70 and the cooling fan 67 performed by the control unit 200 will be described.

As illustrated in FIG. 16, the developing apparatus 4A (4B, 4C, 4D) includes the developing sleeve 44*a*, the cooling duct 55, and the airflow space portion 52. In addition to this, the image forming apparatus of the present embodiment includes the cooling fan 67 that sends air into the cooling duct 55, and the drawing fan 70 that draws air of the cooling duct 55 and the airflow space portion 52. Furthermore, in the present embodiment, a temperature-and-humidity sensor 201 is disposed outside the developer container 41 for detecting the temperature and the humidity around the developing apparatus 4A. The temperature-and-humidity sensor 201 serves as a temperature detection portion and a humidity detection portion, and detects the temperature and the humidity around the developing apparatus 4A. Thus, the control unit 200 determines the operation of the cooling fan 67 and the drawing fan 70, depending on a detection result by the temperature-and-humidity sensor 201.

Figure 17A:
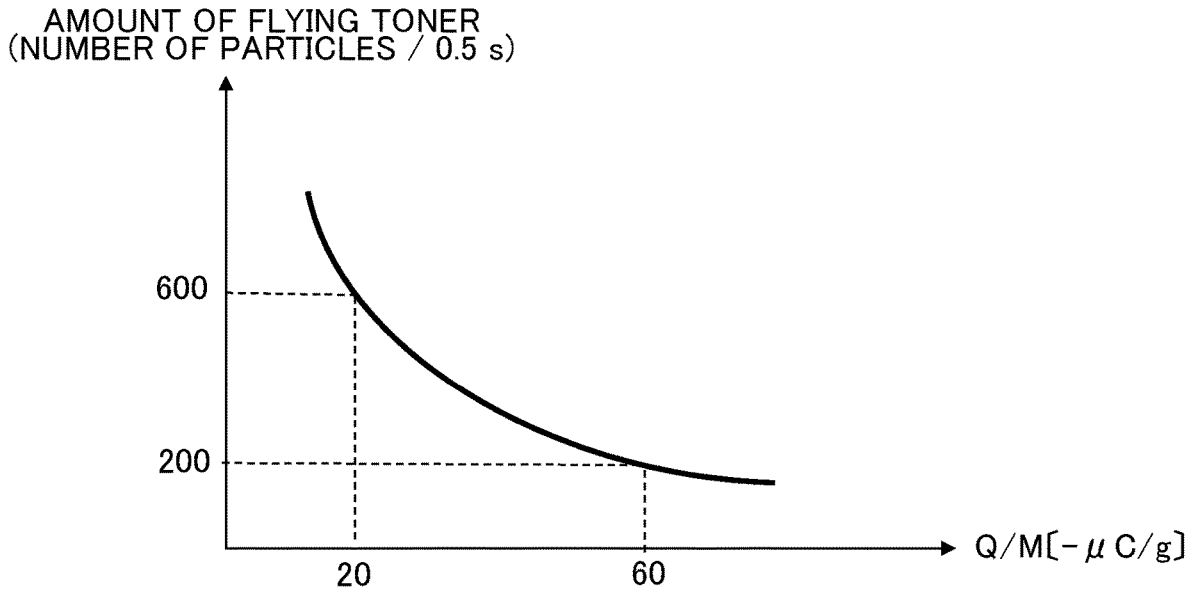
FIG. 17A is a graph illustrating a relationship between the amount of charge of toner (Q/M) and the amount of scattering toner.

By the way, if the amount of charge of the toner decreases in the developing apparatus 4A, the force that causes toner to electrostatically stick to carrier decreases in the developer. As a result, the toner is easily separated from the carrier, and the amount of scattering toner increases. Thus, the amount of scattering toner depends on the amount of charge of the toner (hereinafter referred to as Q/M). In addition, since Q/M changes in accordance with the humidity around the developing apparatus 4A, Q/M depends on the humidity around the developing apparatus 4A. FIG. 17A illustrates the Q/M dependence of the amount of scattering toner, and FIG. 17B illustrates the humidity dependence of Q/M.

FIG. 17A illustrates a measurement result obtained by preparing a plurality of types of developer, each containing toner whose Q/M had been adjusted to have a different value, then circulating each developer in the developing apparatus of the present embodiment, and then measuring toner that flew from the developing sleeve 44*a*, by using the following method. First, an almost central portion of the developing sleeve 44*a* was irradiated with a line laser beam. The line laser beam was scattered toward a predetermined direction via a cylindrical lens, so that the line laser beam had a predetermined line width and a line-shaped portion of the developing sleeve 44*a* was irradiated with the line laser beam. The toner that is scattering in the optical path of the line laser beam scatters the line laser beam. Thus, by observing the scattering toner from a direction substantially perpendicular to the direction in which the line laser beam is emitted, it is possible to measure the number of particles and trajectory of scattering toner that exists in an area irradiated with the laser beam of the line laser beam.

The light source of the line laser beam was a YAG laser made by Japan Laser Corporation. The cylindrical lens was adjusted so that the line laser beam had a line width of 0.5 mm, and the developing sleeve 44*a* was irradiated with the line laser beam. The observation was performed by using a high-speed camera, SA-3, made by PHOTRON LIMITED, and settings (frame rate and exposure time) of the high-speed camera and the type of an optical component (e.g., lens) were selected appropriately for observing the scattering toner that existed in the optical path of the line laser beam. By using the above-described method, the number of particles of toner that flew from the developing apparatus was measured for each developer having a corresponding amount of charge of toner.

Figure 17B:
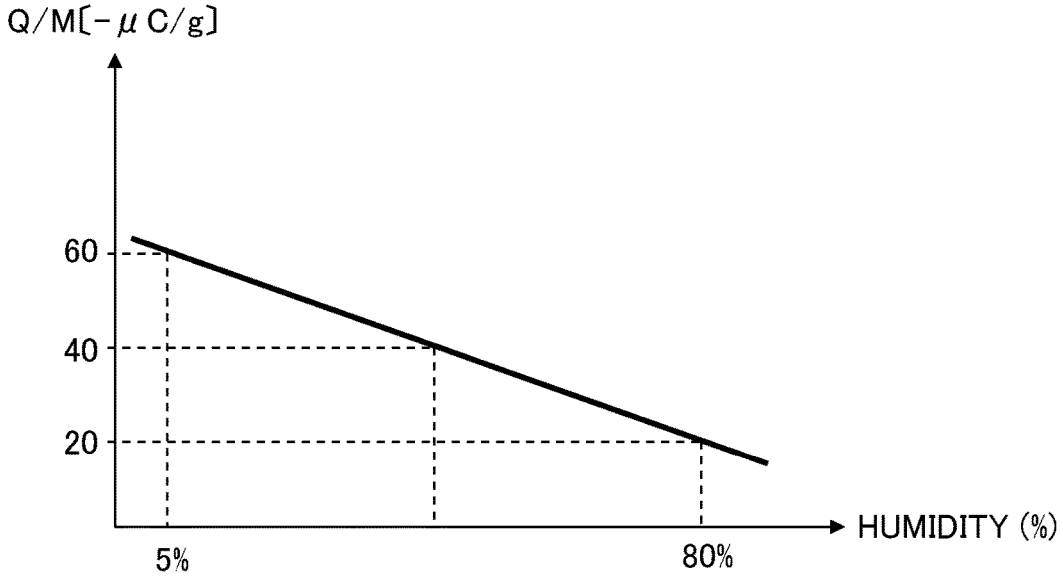
FIG. 17B is a graph illustrating a relationship between the humidity and the amount of charge of toner (Q/M).

FIG. 17B illustrates measurement results of Q/M of toner that had been left for 72 hours at a plurality of temperatures and humidities. The measurement of the amount of charge of toner, Q/M, was performed by using an electric-field-separation charge-amount measuring instrument made by ETWAS Corporation, in an environment with a room temperature of 23 degrees and a humidity of 50%.

As illustrated in FIG. 17B, Q/M depends on the humidity; and as illustrated in FIG. 17A, the amount of scattering toner depends on Q/M. Thus, in an environment with high humidity and low Q/M, the toner easily scatters. For this reason, in the environment with high humidity, it is desired to immediately draw the scattering toner by increasing the output of the drawing fan 70, which collects the scattering toner.

On the other hand, if the environment around the developing apparatus has high temperature, the developer melts and accumulates in the developer container 41. A lump of accumulated toner may be conveyed to the developing sleeve 44*a*, and supplied to the photosensitive drum 1A for developing an electrostatic latent image. The lump of toner supplied to the photosensitive drum 1A for developing the electrostatic latent image causes a stain in an image, leading to an image defect when the image is outputted. Thus, for preventing the image defect caused by high temperature, it is desired to cool the developer container 41 by increasing the movement of the cooling fan 67 when the environment around the developing apparatus 41 has high temperature.

Thus, in the present embodiment, the amount of air generated by the cooling fan 67 and the amount of air generated by the drawing fan 70 are adjusted by adjusting the ratio of the output of the cooling fan 67 to the output of the drawing fan 70 in accordance with the environment (the cooling fan 67 and the drawing fan 70 are disposed outside the developer container 41). Specifically, if the temperature detected by the temperature-and-humidity sensor 201 is a first temperature, the control unit 200 sets the output of the cooling fan 67 at a first cooling output. In addition, if the temperature detected by the temperature-and-humidity sensor 201 is a second temperature higher than the first temperature, the control unit 200 sets the output of the cooling fan 67 at a second cooling output larger than the first cooling output. That is, the control unit 200 controls the cooling fan 67 such that the output of the cooling fan 67 increases as the temperature around the developing apparatus 4A increases, for suppressing the temperature rise of the developer of the developing apparatus 4A.

On the other hand, if the humidity detected by the temperature-and-humidity sensor 201 is a first humidity, the control unit 200 sets the output of the drawing fan 70 at a first drawing output. In addition, if the humidity detected by the temperature-and-humidity sensor 201 is a second humidity higher than the first humidity, the control unit 200 sets the output of the drawing fan 70 at a second drawing output larger than the first drawing output. That is, the control unit 200 controls the drawing fan 70 such that the output of the drawing fan 70 increases as the humidity around the developing apparatus 4A increases, for suppressing the toner from scattering from the developing apparatus 4A.

By the way, if the output of the cooling fan 67 exceeds the output of the drawing fan 70, the air may leak from the developing apparatus 4A, and blow against the photosensitive drum and other developing apparatuses that contain different colors of developer. As a result, the toner may fly in the interior of the image forming apparatus and make the interior of the image forming apparatus dirty. For example, if the cooling fan 67 and the drawing fan 70 are identical fans, and the output of the cooling fan 67 exceeds the output of the drawing fan 70, such a problem may occur. In practice, since not only the output of the fans but also the length of an airflow path and the pressure loss are factors that lead to such a problem, it is preferable to control the output of the two fans in consideration of these factors such that the air from the cooling fan 67 does not flow backward toward the airflow space portion 52.

In the present embodiment, the control unit 200 causes the temperature-and-humidity sensor 201 to detect the temperature and the humidity around the developing apparatus 4A, and changes the output (i.e., ratio on the number of rotations) of the two fans (the cooling fan 67 and the drawing fan 70) depending on an environment table created in consideration of temperature-and-humidity environment. FIG. 18 illustrates one example of the environment table.

In the example of FIG. 18, the cooling fan 67 and the drawing fan 70 rotate at 1000 rpm when their output is 100%. In addition, a symbol "A" of FIG. 18 indicates the output of the cooling fan 67, and a symbol "B" indicates the output of the drawing fan 70. Furthermore, in the environment table illustrated in FIG. 18, the output DUTY of the cooling fan 67 and the drawing fan 70 varies depending on the temperature and the humidity. Since the air may leak from the developing apparatus when the output of the cooling fan 67 exceeds the output of the drawing fan 70, the output DUTY is set such that the output of the cooling fan 67 (that forces air to flow into the cooling duct) does not exceed the output of the drawing fan 70. As described above, when the output of the cooling fan 67 is indicated by the symbol "A" and the output of the drawing fan 70 is indicated by the symbol "B", it is preferable that the ratio of "A" to "B" satisfies the relationship of $0 \leq A/B \leq 1.0$.

The output illustrated in FIG. 18 was determined by forming an A4-size image with an image DUTY of 50% on 40,000 sheets in each environment and checking the dirt on a roller and the stain image for each of the outputted sheets. The dirt on a roller is caused by the scattering toner and causes dirt on an image, and the stain image is caused by the temperature rise.

For example, if the humidity is 80% and the temperature is 40° C., the risk of the scattering toner and the stain image increases. In this case, the output DUTY of the cooling fan 67 and the drawing fan 70 is set at 100% for maximizing the drawing force for the scattering toner and actively cooling the developing apparatus 4A.

In contrast, if the humidity is 20% and the temperature is 20° C., it is not necessary to actively cool the developing apparatus 4A, and the risk of the scattering toner is low. In this case, the output DUTY of the cooling fan 67 and the drawing fan 70 is decreased. Thus, by setting the output DUTY of the cooling fan 67 and the drawing fan 70 at optimum values in accordance with the temperature and humidity around the developing apparatus 4A, the noise and the power consumption can be suppressed appropriately. Note that since the output illustrated in FIG. 18 is one example, the output may be changed in accordance with the physical properties of toner or the specifications of the fans used.

Figure 19:
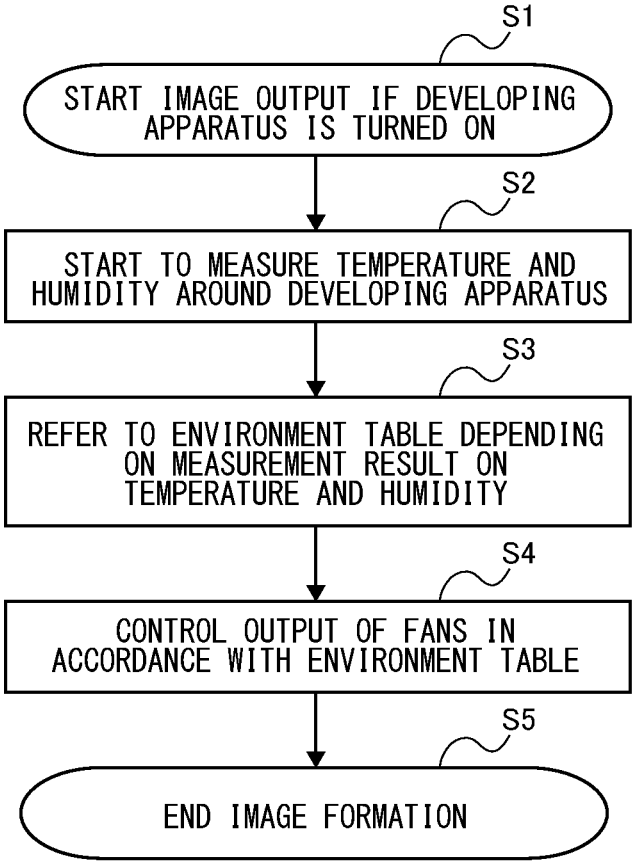
FIG. 19 is a flowchart illustrating the fan control of the third embodiment.

FIG. 19 illustrates one example of a flowchart for controlling the output of the cooling fan 67 and the output of the drawing fan 70 of the present embodiment. As illustrated in FIG. 19, the control unit 200 starts to control the fans, for example, at a timing at which the control unit 200 receives an image-forming job instruction and starts to drive the developing apparatus (S1). The image forming job is performed depending on a print signal (image forming signal) for forming an image on a recording material, and is performed for a period of time from when the image formation is started until when the image formation is completed. That is, the image forming job is performed when the image forming apparatus receives the image forming signal, and is performed for a period of time in which a series of operations is performed. The series of operations includes a pre-operation (pre-rotation) performed before the image forming operation, the image forming operation, and a post-operation (post-rotation) performed after the image forming operation.

After starting to drive the developing apparatus, the control unit 200 causes the temperature-and-humidity sensor 201 disposed around each of the developing apparatuses of four colors to start to measure the temperature and humidity at a timing at which each image forming operation is completed (the trailing edge of an image is formed), and at a timing at which the developing apparatus is stopped when the post-rotation operation including the adjustment control is stopped (S2). Then the control unit 200 refers to the environment table illustrated in FIG. 18 (S3), and controls the output of the cooling fan 67 and the drawing fan 70 in accordance with a measurement result obtained by the temperature-and-humidity sensor 201 (S4). After that, the control unit 200 ends the image forming operation if the image forming job is completed (S5).

Example

To confirm the effect of the present embodiment, the following experiment was conducted. In the experiment, four developing apparatuses of Comparative Example were disposed in the image forming apparatus 100, in place of the developing apparatuses 4A to 4D. Similarly, four developing apparatuses of Example 3 were disposed in the image forming apparatus 100, in place of the developing apparatuses 4A to 4D. The configuration of Comparative Example was the configuration described in Japanese Patent Application Publication No. 2018-180267. In the configuration, the areas of the two outlets, that is, the area of the outlet of the path for drawing the scattering toner and the area of the outlet of the path for cooling the developing apparatus were changed by rotating a semicircular member, so that the operation mode was switched between a mode in which the drawing of the scattering toner has priority and a mode in which the cooling of the developing apparatus has priority.

In the experiment, an A4-size image with an image DUTY of 50% was formed on 40,000 sheets, and the dirt on a roller and the stain image were checked for each of the outputted sheets. The dirt on a roller is caused by the scattering toner and causes dirt on an image, and the stain image is caused by the temperature rise. The experiment was conducted in a laboratory. For setting the environment of the laboratory, the temperature and the humidity were set at 30° C. and 80%, and 10° C. and 80%.

In Example 3, in the environment in which the temperature was 30° C. and the humidity was 80%, the number A of rotations of the cooling fan 67 was set at 1000 rpm, and the number B of rotations of the drawing fan 70 was set at 1000 rpm (A/B=1). In addition, in the environment in which the temperature was 10° C. and the humidity was 80%, the number A of rotations of the cooling fan 67 was set at 200 rpm, and the number B of rotations of the drawing fan 70 was set at 1000 rpm (A/B=0.2).

The developing apparatus of Comparative Example adjusts the ratio of the area of the cooling-air outlet to the area of the scattering-toner outlet, by using a shutter. In the environment in which the temperature was 30° C. and the humidity was 80%, the ratio of the area C of the cooling-air outlet to the area D of the scattering-toner outlet was set at 1 (C/D=1). In the environment in which the temperature was 10° C. and the humidity was 80%, the ratio of the area C of the cooling-air outlet to the area D of the scattering-toner outlet was set at 0.2 (C/D=0.2).

The following Table 2 and Table 3 illustrate experimental results.

TABLE 2

| ENVIRONMENT 30° C./80% | | | | |
|---|---|---|---|---|
| | ROLLER DIRT | STAIN IMAGE | SHUTTER | FAN DUTY |
| COMPARATIVE EXAMPLE | NOT OBSERVED | NOT OBSERVED | USED (C/D = 1) | 100% |
| EXAMPLE 3 | NOT OBSERVED | NOT OBSERVED | NOT USED | A: 100% B: 100% |

TABLE 3

| ENVIRONMENT 10° C./80% | | | | |
|---|---|---|---|---|
| | ROLLER DIRT | STAIN IMAGE | SHUTTER | FAN DUTY |
| COMPARATIVE EXAMPLE | NOT OBSERVED | NOT OBSERVED | USED (C/D = 0.2) | 100% |
| EXAMPLE 3 | NOT OBSERVED | NOT OBSERVED | NOT USED | A: 20% B: 100% |

As illustrated above, compared to Comparative Example, it is understood that Example 3 can prevent the dirt on a roller caused by the scattering toner and the stain image caused by temperature rise, without using the shutter.

Modifications

In the developing apparatus of each of the above-described embodiments, the developer is supplied from the second developer-conveyance path (second chamber) 45*b* to the developing sleeve (developer bearing member) 44*a* and collected from the developing sleeve 44*a* in the first developer-conveyance path (first chamber) 45*a*. However, the developer may be supplied from the second chamber to the developer bearing member and collected from the developer bearing member in the second chamber. In addition, in the developing apparatus, the first chamber and the second chamber may not be disposed vertically. For example, the first chamber and the second chamber may be disposed adjacent to each other in a horizontal direction, or in a direction inclined with respect to the horizontal direction.

The image forming apparatus of the present disclosure can be applied to, for example, copying machines, printers, facsimiles, and multifunction printers having a plurality of functions of these products.

OTHER EMBODIMENTS

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2020-075814, filed on Apr. 22, 2020, and Japanese Patent Application No. 2021-042240, filed on Mar. 16, 2021, which are hereby incorporated by reference herein in their entirety.

What is claimed is:

1. An image forming apparatus comprising:

an image bearing member;

an exposure apparatus configured to expose the image bearing member for forming an electrostatic latent image on the image bearing member;

a developing apparatus comprising:

a developer container configured to accommodate developer that contains toner and carrier, a developing rotary member configured to bear the developer and convey the developer to a developing position at which the electrostatic latent image formed on the image bearing member is developed, and a driving-force transmission member disposed on a side on which the developer container faces the image bearing member and on one end side of the developing rotary member in a rotation-axis direction of the developing rotary member, and configured to transmit driving force to the developing rotary member to rotate the developing rotary member;

a driving device disposed on the side on which the developer container faces the image bearing member and on the one end side of the developing rotary member in the rotation-axis direction of the developing rotary member, and configured to provide the driving force to the driving-force transmission member;

an airflow space portion disposed on the side on which the developer container faces the image bearing member, formed from the one end side to another end side of the developing rotary member in the rotation-axis direction of the developing rotary member, and configured to serve as a flow path of air that collects toner that scatters from the developing rotary member;

a duct disposed on the one end side of the developing rotary member in the rotation-axis direction of the developing rotary member and underneath the developer container, formed from the side on which the developer container faces the image bearing member to a side opposite to the side on which the developer container faces the image bearing member, and connected to the airflow space portion such that air flows between the airflow space portion and the duct; and a drawing fan disposed on the side opposite to the side on which the developer container faces the image bearing member and on the one end side of the developing rotary member in the rotation-axis direction of the developing rotary member, and configured to draw air from an opening portion of the duct for generating airflow in the airflow space portion, wherein the developer container comprises a first side wall portion disposed on the one end side of the developing rotary member in the rotation-axis direction, a second side wall portion disposed on the other end side of the developing rotary member in the rotation-axis direction, and a projection portion disposed between the first side wall portion and the second side wall portion in the rotation-axis direction and projecting toward the image bearing member, wherein the airflow space portion is a space surrounded by the developing bearing member, the image bearing member, the first side wall portion, the second side wall portion, and the projection portion, and wherein the airflow space portion is configured to overlap with the developing position in the gravity direction.

2. The image forming apparatus according to claim 1, further comprising a cooling duct disposed on the side opposite to the side on which the developer container faces the image bearing member, formed from the one end side to the other end side of the developing rotary member in the rotation-axis direction of the developing rotary member, and configured to form a flow path of air that cools the developer container, wherein airflow is generated in the cooling duct by the drawing fan drawing air from an opening portion of the cooling duct.

3. The image forming apparatus according to claim 1, further comprising a cooling duct disposed on the side opposite to the side on which the developer container faces the image bearing member, formed from the one end side to the other end side of the developing rotary member in the rotation-axis direction of the developing rotary member, and configured to form a flow path of air that cools the developer container, wherein the cooling duct is configured to join the duct in a position located on the side opposite to the side on which the developer container faces the image bearing member and on the one end side of the developing rotary member in the rotation-axis direction of the developing rotary member, and wherein airflow is generated in the airflow space portion and the cooling duct by the drawing fan drawing air from the opening portion of the duct.

4. The image forming apparatus according to claim 1, wherein the developing apparatus further comprises:

a supply chamber configured to supply the developer to the developing rotary member;

a collection chamber configured to collect the developer that has passed the developing position, from the developing rotary member;

a first communicating portion configured to cause the collection chamber and the supply chamber to communicate with each other such that the developer moves from the collection chamber to the supply chamber;

a second communicating portion configured to cause the supply chamber and the collection chamber to communicate with each other such that the developer moves from the supply chamber to the collection chamber;

a first conveyance screw disposed in the supply chamber and configured to convey the developer in a first direction extending from the first communicating portion toward the second communicating portion; and a second conveyance screw disposed in the collection chamber and configured to convey the developer in a second direction extending from the second communicating portion toward the first communicating portion, wherein the other end side of the developing rotary member in the rotation-axis direction of the developing rotary member is located upstream of an image forming area that allows an image to be formed on the image bearing member, in the first direction, and wherein the one end side of the developing rotary member in the rotation-axis direction of the developing rotary member is located downstream of the image forming area in the first direction.

5. The image forming apparatus according to claim 1, wherein the projection portion is provided across the entire area between the first side wall portion and the second side wall portion in the rotation-axis direction of the developing rotary member.

6. The image forming apparatus according to claim 1, wherein the first wall portion has an inflow opening portion that allows air to flow into the airflow space portion from outside the developer container, and wherein the second wall portion has a drawing opening portion that allows air to be drawn from the airflow space portion to the duct.

7. An image forming apparatus comprising:

an apparatus body;

a first image forming portion including a first image bearing member on which an electrostatic latent image is formed and a first developing apparatus, the first developing apparatus including a first developer container configured to accommodate developer that contains toner and carrier, and a first developing rotary member configured to bear the developer and convey the developer to a first developing position at which the electrostatic latent image formed on the first image bearing member is developed, the first image forming portion being configured to form a toner image on the first image bearing member;

a second image forming portion including a second image bearing member on which an electrostatic latent image is formed and a second developing apparatus, the second developing apparatus including a second developer container configured to accommodate developer that contains toner and carrier, and a second developing rotary member configured to bear the developer and convey the developer to a second developing position at which the electrostatic latent image formed on the second image bearing member is developed, the second image forming portion being configured to form a toner image on the second image bearing member;

a movable intermediate transfer member to which the toner image formed on the first image bearing member by the first image forming portion is transferred at a first transferring position and the toner image formed on the second image bearing member by the second image forming portion is transferred at a second transferring position;

an airflow space through which air can flow, the air airflow space being formed by the second developer container and the second image bearing member along a rotation-axis direction of the second developing rotary member from one end side toward the other end side of the second developing rotary member, the air airflow space being disposed downstream of the second developing position in a rotational direction of the second developing rotary member;

a first duct provided in the second developing apparatus, the first duct including a first inlet disposed the one end side of the second developing rotary member in the rotation-axis direction and connected to the airflow space so that the air in the airflow space is taken into the first duct from the first inlet, and an outlet that is disposed on the one end side of the second developing rotary member in the rotation-axis direction and from which the air taken from the first inlet is discharged;

a second duct that the apparatus body has, the second duct including a second inlet disposed on the one end side of the second developing rotary member in the rotation-axis direction, the second inlet being connected to the outlet so that the air discharged from the outlet is taken into the second inlet; and a drawing fan provided in the second duct and configured to draw the air in the second duct, wherein the second developing apparatus includes a back surface disposed on a side opposing to a side which the second developing apparatus faces the second image bearing member in a moving direction of the intermediate transfer member from the first transferring position toward the second transferring position, wherein the first inlet is disposed downstream of the outlet and downstream of the back surface of the second developing apparatus in the moving direction of the intermediate transfer member from the first transferring position toward the second transferring position, and wherein the second inlet is disposed upstream of the outlet and upstream of the back surface of the second developing apparatus in the moving direction of the intermediate transfer member from the first transferring position toward the second transferring position.

8. The image forming apparatus according to claim 7, further comprising a third duct provided in the second developing apparatus, the third duct being formed along the rotation-axis direction of the second developing rotary member from the one end side toward the other end side of the second developing rotary member, wherein the third duct is disposed upstream of the air flow space in the moving direction of the intermediate transfer member from the first transferring position toward the second transferring position, and wherein the first duct includes a joining portion that is disposed on the one end side of the second developing rotary member in the rotation-axis direction and where the air in the third duct join the air in the first duct.

9. The image forming apparatus according to claim 8, further comprising an air discharging fan, wherein the third duct includes a third inlet that is disposed on the other end side of the second developing rotary member in the rotation-axis direction and through which the air discharged from the air discharging fan is taken in.

10. The image forming apparatus according to claim 7, wherein the second developer container comprises a first side wall portion disposed on the one end side of the second developing rotary member in the rotation-axis direction, a second side wall portion disposed on the other end side of the second developing rotary member in the rotation-axis direction, and a projection portion disposed between the first side wall portion and the second side wall portion in the rotation-axis direction and projecting toward the second image bearing member, wherein the airflow space portion is a space surrounded by the second image bearing member, the first side wall portion, the second side wall portion, and the projection portion.

11. The image forming apparatus according to claim 10, wherein the projecting portion is provided across the entire area between the first side wall portion and the second side wall portion in the rotation-axis direction of the second developing rotary member.

12. The image forming apparatus according to claim 7, further comprising a driving device configured to supply a driving force for driving the second developing rotary member; and a driving-force transmission member disposed on the one side of the second developing rotary member in the rotation-axis direction and configured to transmit the driving force from the driving device to the second developing rotary member.

13. The image forming apparatus according to claim 12, wherein the driving devise is disposed on the one end side of the second developing rotary member in the rotation-axis direction.

14. The image forming apparatus according to claim 7, further comprising a driving device configured to supply a driving force for driving the second developing rotary member, wherein the driving device is disposed on the one end side of the second developing rotary member in the rotation-axis direction.

* * * * *